US008663409B2

(12) United States Patent
Mueller

(10) Patent No.: US 8,663,409 B2
(45) Date of Patent: Mar. 4, 2014

(54) TOUCH FASTENING

(75) Inventor: Peter J. Mueller, Durham, CT (US)

(73) Assignee: Velcro Industries B.V., Willemstad, Curacao ( * ) Notice: Subject to any disclaimer, the term of this patent is extended or adjusted under 35 U.S.C. 154(b) by 0 days.

(21) Appl. No.: 13/511,036

(22) PCT Filed: Aug. 3, 2011

(86) PCT No.: PCT/US2011/046361
§ 371 (c)(1),
(2), (4) Date: May 21, 2012

(87) PCT Pub. No.: WO2012/018879
PCT Pub. Date: Feb. 9, 2012

(65) Prior Publication Data

US 2012/0267033 A1 Oct. 25, 2012

Related U.S. Application Data

(60) Provisional application No. 61/370,317, filed on Aug. 3, 2010.

(51) Int. Cl.

| | |
|---|---|
| ***A61F 13/15*** | (2006.01) |
| ***A41H 37/00*** | (2006.01) |
| ***A44B 18/00*** | (2006.01) |
| ***B29C 65/00*** | (2006.01) |
| ***B65D 85/00*** | (2006.01) |

(52) U.S. Cl.
USPC ..... 156/62.2; 156/66; 156/298; 156/308.2; 24/448; 206/341; 428/100

(58) Field of Classification Search
USPC ..... 24/442, 443, 446, 447, 449, 450, 451, 24/448, 452; 156/62.2, 66, 285, 297, 298, 156/300, 301, 302, 303, 308.2; 206/341, 206/342, 346, 347, 206; 428/100
See application file for complete search history.

(56) References Cited

U.S. PATENT DOCUMENTS 3,128,514 A * 4/1964 Parker et al. ..... 24/11 HC
3,494,006 A * 2/1970 Brumlik ..... 24/447

(Continued)

FOREIGN PATENT DOCUMENTS

EP 1810754 7/2007
GB 2399496 A 9/2004

(Continued)

OTHER PUBLICATIONS

International Preliminary Report on Patentability and Written Opinion; Baharlou; Feb. 14, 2013; World Intellectual Property Organization (WIPO) (International Bureau of); PCT/US/2011/046361; 7 pages.

(Continued)

*Primary Examiner* — Linda L. Gray
(74) *Attorney, Agent, or Firm* — Fish & Richardson P.C.

(57) ABSTRACT

Touch fastener products (10) are made by distributing a multiplicity of discrete fastening bits (14, 14*a*, 14*b*) over a support surface (12) and fixing the distributed bits (14, 14*a*, 14*b*) to the support surface (12), such as by an adhesive (32). Each bit (14, 14*a*, 14*b*) has opposite side surfaces (24, 24*b*, 26, 26*b*) forming boundaries of surfaces defining projections (16) extending in different directions from the fastening bits (14, 14*a*, 14*b*), at least one of the opposite side surfaces (24, 24*b*, 26, 26*b*) being non-planar, and each projection (16) has an overhanging head (18). As fixed, each bit (14, 14*a*, 14*b*) is oriented with at least one of its projection heads (18) raised from the support surface (12) to releasably engage fibers (30). Bits (14, 14*a*, 14*b*) are made by pelletizing shaped rails (36). Applications include securing floor coverings (150).

32 Claims, 22 Drawing Sheets

(56) References Cited

U.S. PATENT DOCUMENTS

| | | | | |
|---|---|---|---|---|
| 4,288,036 | A | 9/1981 | Jubinville | |
| 5,188,263 | A | 2/1993 | Woods | |
| 5,450,983 | A | 9/1995 | Stern et al. | |
| 5,749,129 | A * | 5/1998 | Murasaki et al. | 24/452 |
| 6,056,901 | A | 5/2000 | Hamatani et al. | |
| 6,106,944 | A | 8/2000 | Heikkila et al. | |
| 6,112,945 | A | 9/2000 | Woods | |
| 6,352,184 | B1 | 3/2002 | Stern et al. | |
| 6,666,352 | B1 | 12/2003 | Woods | |
| 7,226,001 | B1 | 6/2007 | Stern et al. | |
| 7,308,738 | B2 * | 12/2007 | Barvosa-Carter et al. | 24/442 |
| 7,374,068 | B2 | 5/2008 | Greer | |
| 7,487,893 | B1 | 2/2009 | Greer, Jr. et al. | |
| 7,784,649 | B2 | 8/2010 | Greer, Jr. | |
| 8,082,637 | B2 * | 12/2011 | Tolan et al. | 24/452 |
| 2004/0261232 | A1 | 12/2004 | Kurtz et al. | |
| 2005/0181171 | A1 | 8/2005 | Ausen et al. | |
| 2005/0181352 | A1 * | 8/2005 | Shephard et al. | 434/428 |
| 2008/0021144 | A1 | 1/2008 | Stahlberg et al. | |
| 2009/0068463 | A1 | 3/2009 | Mochizuki et al. | |
| 2009/0130443 | A1 | 5/2009 | Lustiger | |
| 2009/0188948 | A1 | 7/2009 | Stern et al. | |
| 2013/0219677 | A1 * | 8/2013 | Idrizovic et al. | 24/452 |

FOREIGN PATENT DOCUMENTS

| | | | |
|---|---|---|---|
| WO | WO0133989 | A1 | 5/2001 |
| WO | WO2010050831 | A1 | 5/2010 |

OTHER PUBLICATIONS

International Search Report and Written Opinion; Diebold; Apr. 20, 2012; World Intellectual Property Organization (WIPO) (International Bureau of); PCT/US/2012/021662; 11 pages.

International Search Report/Written Opinion for International Application No. PCT/US2011/046361 mailed Dec. 8, 2011 (16 pages).

Texture Paint Spray Gun; Model 66103; Set Up and Operating Instructions; Central Pneumatic; Distributed exclusively by Harbor Freight Tools, 2008; 13 pages.

* cited by examiner

FIG. 23
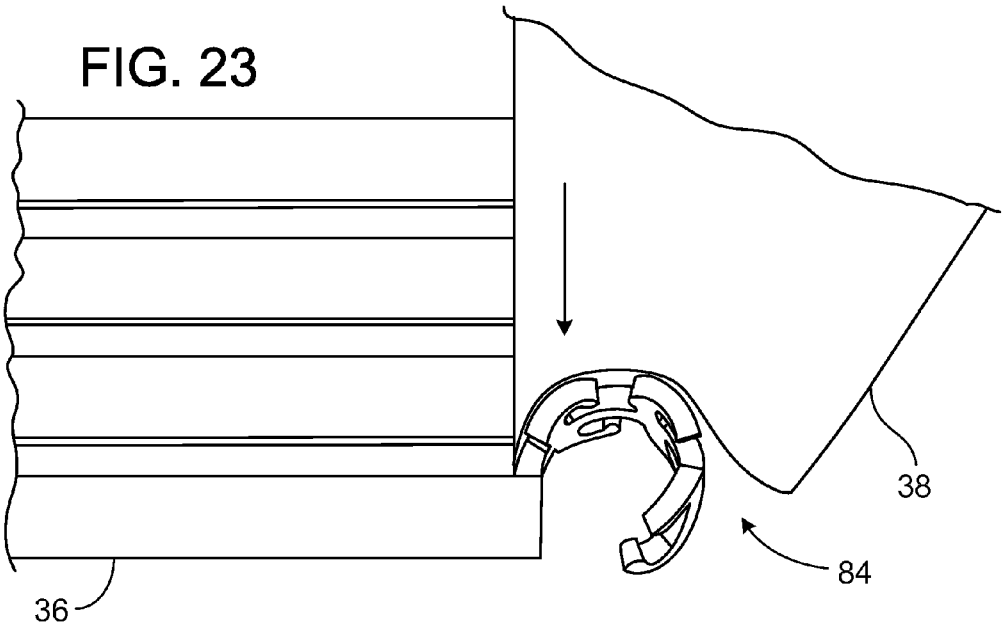
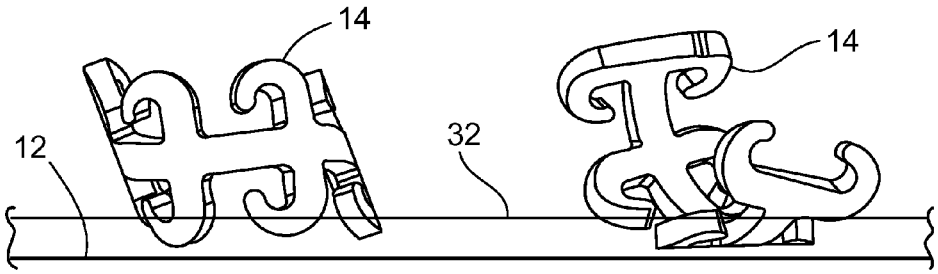
FIG. 24
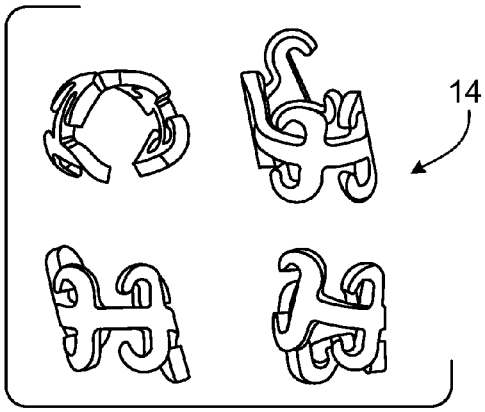
FIG. 25

TOUCH FASTENING

CROSS REFERENCE TO RELATED APPLICATIONS

This application is a §371 National Stage Application of International Application No. PCT/US2011/046361, filed Aug. 3, 2011, which claims priority to U.S. Provisional Application No. 61/370,317, filed Aug. 3, 2010, each of which is incorporated herein by reference in its entirety.

TECHNICAL FIELD

This invention relates to touch fastener products, their manufacture and their application for various purposes, and more particularly to touch fastener products useful for the releasable engagement of fibrous surfaces.

BACKGROUND

Mechanical touch fastening involves the engagement of a field of fastening elements, such as hooks, with a field of mating elements, such as fibers of a fabric. Although mechanical engagement may be said to happen between individual fastening elements, which may themselves be extremely small, the overall characteristics of the fastening are described in terms of the aggregate of a great number of individual engagements across a broad area. Such fastening systems are generally designed, therefore, with an eye to statistical engagement, as it is not generally feasible to accurately position corresponding hooks and fibers to ensure their mutual engagement.

In many touch fastening systems the positioning of the fibers, in particular, is relatively random or statistical, even when such fibers are of a fabric formed by weaving or knitting. In non-woven materials fiber positioning and orientation is even more random.

The hook side of touch fastening systems may be formed so as to have a fairly regular and controlled positioning and orientation of male fastening elements, such as by molding them in a regular pattern of rows and columns as part of a fastener strip. In some other cases they are formed by severing or trimming loops extending from a woven fabric.

In generally available commercial touch fastening systems, the hook side of the fastening is manufactured as a strip or patch that carries the array of hooking elements and is then affixed to a surface to which something is to be releasably secured. In the manufacture of disposable diapers, for example, pre-formed fastening strips carrying arrays of male fastening elements are typically fixed to a material that forms a diaper tab that is, in turn, fixed to a diaper chassis. The fiber or loop side of the fastening system may be, in some cases, already available (such as in the form of the outer surface of a fibrous garment), or is supplied by securing a patch or strip of loop material manufactured specifically for certain touch fastening properties.

Improvements are continually sought for more efficient and adaptable ways to provide surface with fastening properties, and in the manufacture of fastening products.

SUMMARY

The invention involves a realization that an effective touch fastening surface can be formed by fixing individual, discrete fastening bits to that surface in a way that enables the bits to snag a mating surface, such as a field of engageable fibers.

One aspect of the invention features a method of making a touch fastener product. The method includes distributing a multiplicity of discrete fastening bits over a support surface, each bit having opposite side surfaces forming boundaries of surfaces defining projections extending in different directions from the fastening bits, at least one of the opposite side surfaces being non-planar, and each projection having an overhanging head; and fixing the distributed bits to the support surface, with each bit oriented with at least one of its projection heads raised from the support surface to releasably engage fibers.

By "each," I do not mean to preclude that other bits may be distributed over the surface, and/or fixed to the surface, of a configuration or orientation other than as described above. Rather, the term "each" is only meant to apply to those bits being described.

In some examples, distributing the bits causes them to orient with at least one projection head raised from the support surface.

In some cases each bit is oriented, as fixed to the support surface, with at least one projection head extending away from the support surface.

In some embodiments, distributing the bits involves distributing a liquid onto the support surface, the liquid containing the bits in suspension. In such cases, fixing the bits to the support surface may involve evaporating at least a portion of the distributed liquid, and the evaporating may expose projections of the fastening bits.

In some applications, distributing the bits involves distributing the bits in a foam carrier that collapses on the support surface. The foam carrier may be or include an adhesive, for example, that fixes the bits to the support surface.

In some examples the bits are broadcast over the support surface and fall into a position in which they are fixed. The bits may be fixed as they are distributed, for example.

In some cases, the bits are distributed over the support surface by distributing them over a carrier to which they are not permanently fixed, and then placing adhesive of the support surface in contact with the bits. For example, the bits may be spread onto one non-adhesive surface, and then the adhesive support surface may be brought down onto the bits, such that they stick to the support surface, and then lifted off of the carrier.

In some embodiments, the support surface over which the bits are distributed is an adhesive surface, such that the distributed bits land on, and stick to, the support surface. In some examples, fixing the bits to the support surface involves evaporating solvent from the adhesive surface. In some implementations, the support surface is a tacky polymer surface, and the distributed bits are fixed to the support surface as the support surface cools.

In some cases, the support surface includes both adhesive regions and non-adhesive regions, and distributing the bits involves distributing the bits over both the adhesive and non-adhesive regions, and then removing distributed bits from the non-adhesive regions. Removing the distributed bits from the non-adhesive regions may occur after fixing the distributed bits to the support surface, for example.

In some instances, fixing the distributed bits involves heating the bits to cause a portion of each bit to melt and bond to the support surface. For example, the bits may include both a relatively lower melt temperature resin and a relatively higher melt temperature resin, such that heating the bits causes the relatively lower melt temperature resin to flow. The relatively lower melt temperature resin may be embedded in pores defined by the relatively higher melt temperature resin.

In some embodiments the bits are porous, and fixing the distributed bits involves adhesive being drawn from the surface into pores of the bits.

In some cases, fixing the distributed bits causes at least some of the bits to alter their orientation due to adhesive surface tension forces.

In many of the more preferred examples, both of the opposite sides of the bits are non-planar, and may be of complementary topography. By "complementary topography" I mean that the opposite sides are configured such that two identical bits can be nested, with a side of one bit complementing an adjacent side of the other bit. In many cases, the opposite sides are completely complementary, to such an extent that the facing sides of two nested bits will be in contact over all or a substantial majority of their area.

In some implementations, the method also includes, prior to distributing the bits, imparting an electrostatic charge to the bits to inhibit bit clumping.

Another aspect of the invention features a method of installing a floor covering, the method including distributing a multiplicity of discrete fastening bits over a floor, fixing the distributed bits to the floor with adhesive, and placing a floor covering over the floor, the floor covering having exposed fibers on a surface of the floor covering facing the floor, such that the fixed bits engage and retain the exposed fibers of the floor covering to releasably secure the floor covering to the floor. Each bit has opposite side surfaces forming boundaries of surfaces defining projections extending in different directions from the fastening bits, at least one of the opposite side surfaces being non-planar, and each projection has an overhanging head. As fixed to the floor, each bit oriented with at least one of its projection heads raised from the support surface to releasably engage fibers.

The floor covering may be, for example, flexible such as carpet, semi-flexible such as linoleum, or rigid as in wood or simulated wood.

The floor covering may be removable in discrete sections, such as for washing or replacement of a soiled, worn or damaged section without uncovering the entire floor.

The method may include applying the adhesive to the floor before distributing the bits, or applying the adhesive with or after distribution of the bits. The adhesive may be applied so as to cover the floor and provide a floor sealing function in addition to a means of fixing the bits to the floor. In most cases the adhesive will be allowed to cure or otherwise become non-tacky prior to securing the floor covering. In some cases the adhesive will retain some tackiness, such that the floor covering is secured to the floor both by mechanical fastening due to the fastening bits, and by an adhesive retention.

Another aspect of the invention features a method of making a fastening bit. The method includes cutting completely through a longitudinal rail defining a longitudinal axis and having multiple ribs defining undercuts and extending in different directions, the cutting occurring at discrete intervals along the longitudinal axis of the rail to form discrete and separate fastening bits, and collecting the fastening bits. The cutting forms opposite side surfaces of each bit, at least one of which opposite side surfaces is non-planar, such that each bit includes fastening projections formed of severed rib segments.

In some examples, cutting through the rail involves moving a cutter along a substantially linear path through the rail. By "substantially linear" I mean that any deviations from a straight line, over the distance that the cutter moves through the rail, are relatively insignificant. One example of a substantially linear path would be made by a cutter rigidly mounted on a cutter wheel so as to move along a circular path that has a radius at least 40 times a distance that the cutter cuts through the rail.

In some embodiments the cutter comprises a solid cutting edge (as opposed to, for example, a beam or fluid jet). Preferably, the edge forms an acute cutting angle. In some cases the cutting edge is oriented at an acute angle with respect to the cutting direction, such that cutting through the rail shears through the rail toward a lateral rail edge as the cutter advances through the rail.

In some examples the cutter is mounted at an outer edge of a wheel and moves along a circular path. The rail is preferably offset from a rotating axis of the wheel in a forward sense with respect to the direction of rotation, such that the cutter enters and exits the rail at different axial positions along the rail. In some embodiments, the cutter cuts through multiple rails, spaced apart along the circular path, in each revolution of the wheel.

In some embodiments, the rail is cut by rotating a series of wheel-mounted cutters through the rail, while advancing the rail toward a wheel on which the cutters are mounted in spaced-apart circumferential intervals, such that each cutter engages the rail in sequence, cutting a respective fastening bit from the rail. In some cases the rail is one of multiple rails advanced in parallel toward a rotating cutting assembly carrying the series of wheel-mounted cutters. The cutting assembly may have multiple series of wheel-mounted cutters, each series arranged to cut through a respective one or more of the multiple rails.

In some implementations, cutting through the rail causes material being severed from the rail to curl away from the cutter to form a non-planar one of the opposite side surfaces of one of the fastening bits.

In some cases, cutting through the rail is performed while the rail is compressed in a direction of the cutting, such that in an uncompressed state in the fastening bits the opposite side surfaces are of different shape than as cut.

In many examples, each cut through the rail forms a similar cut shape, such that both of the opposing side surfaces of the severed bits are non-planar and of complementary topography.

In some embodiments, the rail is cut with a cutter having a cutting profile that overlaps itself along a longitudinal axis of the rail.

In some cases, the rail is cut with a cutter having a cutting profile that defines a smooth curve perpendicular to a longitudinal axis of the rail, such as a cutter that forms a concave rail end surface, for example.

In some instances, the rail is cut with a cutter having a pointed cutting profile.

In some examples the method also features, while cutting through the rail, supporting the rail on a rail support surface spaced a sufficient distance from the cutter that an unsupported length of rail extending beyond the rail support surface is resiliently deflected during cutting by bending forces induced by the cutting, such that, after the cutting, the unsupported length of rail returns to a position, prior to a subsequent cut, in which an edge of the rail corresponding to an exit point of the cutting extends farther in a longitudinal direction than an edge of the rail corresponding to an entrance point of the cutting.

In some embodiments the method includes, prior to cutting through the rail, forming a stabilization layer around the ribs, such that cutting through the rail involves also cutting through the stabilization layer.

Another aspect of the invention features a fastening bit in the form of a solid body defined between two opposite side surfaces forming opposite boundaries of surfaces defining projections extending in different directions, each projection having an overhanging head defining a crook for engaging fibers and at least one of the opposite side surfaces being non-planar. By "crook" I mean a space bounded on at least two sides and suitable for receiving a fiber snagged by the projection. Some crooks are bounded also by a re-entrant tip, such that they are bounded essentially on three sides by the underside of the overhanging head, to provide some resistance to removal of a snagged fiber pulled away from the stem of the projection. Some crooks have a U-shaped boundary, for example, while some others may have only an L-shaped boundary.

In some embodiments, the projection-defining surfaces are all parallel to a common axis.

In many preferred configurations, both of the opposite side surfaces are non-planar and may be, for example, of complementary topography as discussed above.

In some other configurations, one of the opposite side surfaces is non-planar and the other of the opposite side surfaces is planar, the non-planar opposite side surface defining a projection extending away from the planar opposite side surface and having an overhanging head defining a crook for engaging fibers.

The bit preferably has an overall thickness, measured between the non-planar side surfaces, that is less than a maximum overall linear dimension of the bit.

In many cases the projections extend in more than two different directions.

For many touch fastening applications, all linear dimensions of the bit are preferably less than about 1.2 millimeters.

In many embodiments the solid body consists essentially of polymeric resin containing a thermoplastic. The polymeric resin may include a polymer and at least one filler, for example. In some examples the polymeric resin is or includes a urethane. In some examples the polymeric resin is or includes a copolymer.

Another aspect of the invention features a large quantity of such bits, loosely held in a container in contact with each other.

Yet another aspect of the invention features a touch fastener product having a support surface and a multiplicity of discrete fastening bits dispersed across and fixed to the support surface in various orientations. Each bit has two opposite side surfaces forming boundaries of surfaces defining projections extending in different directions, and each projection has an overhanging head, with at least one of the opposite side surfaces of the bit being non-planar. Each fixed bit is oriented with at least one of the projections extending away from the support surface for releasable engagement of fibers.

In some cases, the fastener product is in the form of a tab connected to and extending from a chassis of a disposable garment, such as a diaper.

In some cases, the support surface is formed of foam, such as of a seat cushion in which the fastening bits provide a means of fastening a cover over the cushion.

In some cases, the fastener product is a longitudinally continuous fastener strip, which may be spooled for storage and shipment.

Another aspect of the invention features a container of bits, in the form of a housing defining an interior volume, and a bulk quantity of discrete bits contained within the volume. As discussed above, the bits are each in the form of a solid body defined between two opposite side surfaces forming opposite boundaries of surfaces defining projections extending in different directions, each projection having an overhanging head defining a crook for engaging fibers and at least one of the opposite side surfaces being non-planar. By "bulk quantity" I mean quantity that would generally be measured by overall volume or weight, consisting of thousands of individual bits.

In some embodiments the bits are loosely disposed within the volume.

In some case, the bits are suspended in a flowable carrier, such as a flowable carrier in liquid form.

Some examples of the container also include a lid covering an opening of the housing and removable to open the interior volume of the container.

In some embodiments the container defines an aperture through which the bits are dispensable by inverting and shaking the container.

For many touch fastening applications the bits are preferably of an average bit size of less than three millimeters across.

Various aspects and/or examples disclosed herein can be useful for providing a touch fastening function to a support surface. By forming discrete fastening bits prior to fixing them to the surface, they may be distributed either generally and broadly at a desired bit density, or distributed precisely where desired. This enables fastening performance to be intentionally varied across a surface, if desired, to optimize fastening characteristics and reduce weight and cost in some applications.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 23 shows forming a curled fastening bit.

FIG. 24 shows the curled fastening bit of FIG. 23 in two stable orientations upon a surface.

FIG. 25 illustrates the fastening bit of FIG. 23, in one perspective and three orthogonal views.

Like reference symbols in the various drawings indicate like elements.

DETAILED DESCRIPTION

Figure 1:
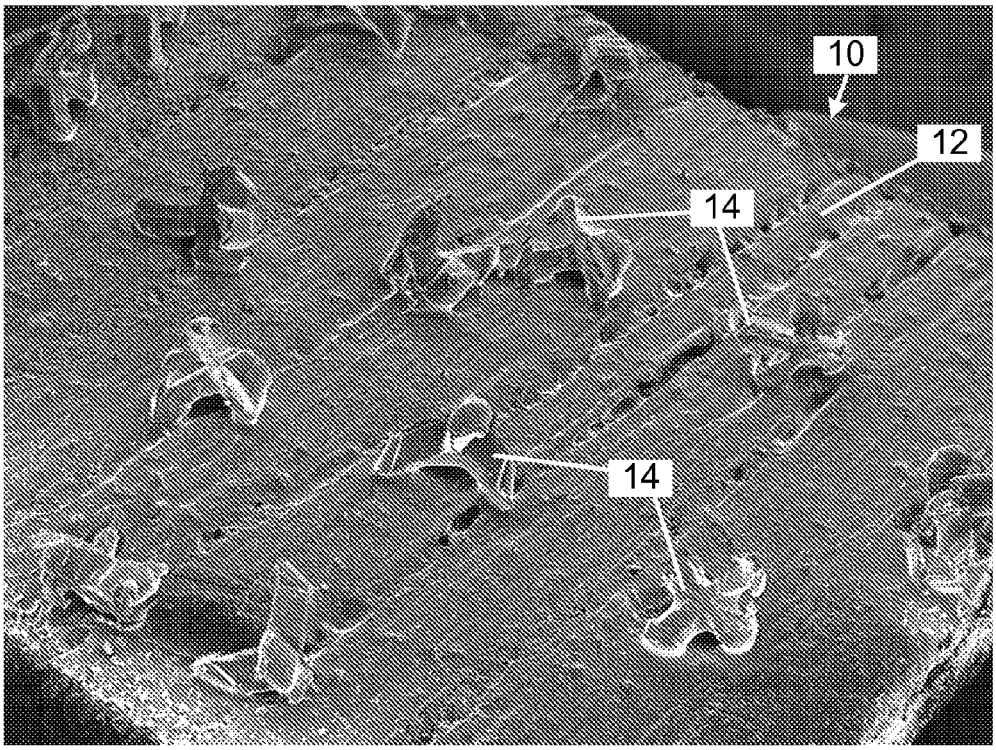
FIG. 1 is an enlarged photograph showing a perspective view of a surface of a touch fastener product to which a number of fastening bits are adhered.

Referring first to FIG. 1, a touch fastener product 10 has a broad support surface 12, with a multiplicity of discrete fastening bits 14 dispersed across and fixed to the support surface 12 in various orientations. The bits 14 are dispersed in a random pattern, each bit being supported by surface 12 and generally separated from the other bits by varying distances. To give some sense of proportion, the bits 14 shown in FIG. 1 are each only about one millimeter across, from tip to tip.

Figure 2:
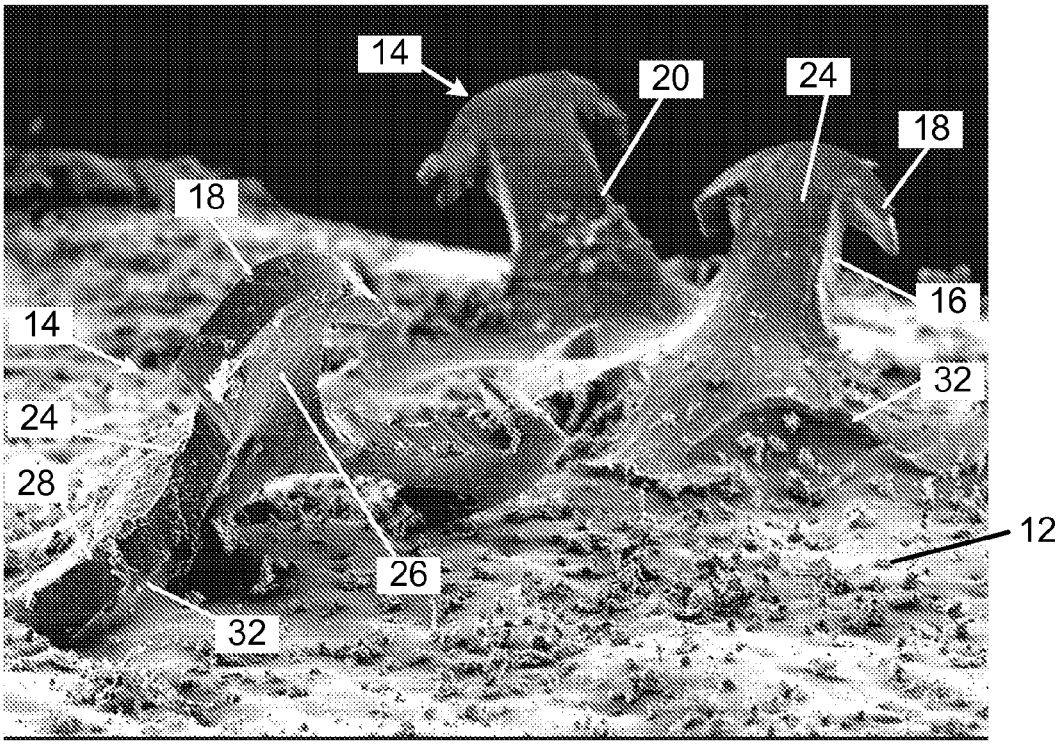
FIG. 2 is an even more enlarged view of a portion of the surface shown in FIG. 1.

Referring also to FIG. 2, which shows an even more greatly enlarged view of surface 12 and a few of the bits 14, each bit 14 has multiple projections 16 extending in different directions, with at least one projection 16 of each bit extending away from surface 12. Each projection has a head 18 that overhangs the bit beyond the neck 20 of the projection, to define crooks 22 for the releasable engagement of fibers. Each bit 14 has two opposite side surfaces 24 and 26 that form boundaries of surfaces 28 that define the projections. Surfaces 28 form the perimeter or profile of each projection, and the opposite side surfaces 24 and 26 form the broad faces of the bits and their projections. Each of the bits has a thickness, measured between its opposite side surfaces 24 and 26, that is less than a maximum overall linear dimension of the bit. In the example shown, the thickness of each bit is only about 0.3 millimeter, while the maximum overall linear bit dimension, in this case measured between opposite projections, is about 1.0 millimeter, such that the ratio of thickness to maximum linear bit dimension is only about 0.3.

Each of the bits 14 shown in FIGS. 1 and 2 has four projections 16 extending in perpendicular directions, such that the bit has an overall shape similar to a '+' symbol, with rounded arrowheads on each projection. In this example, both of the opposite side surfaces 24 and 26 are non-planar, and are of complementary topography. The shape of the bits is such that, at rest on a planar horizontal surface, they will self-orient with at least one projection 16 extending away from the surface, to be available for loop engagement. The bits 14 shown in FIG. 2 each have a thickness, measured between their side surfaces 24 and 26, of about 0.102 millimeter. Bits of a similar profile but of about 0.3 millimeter in thickness, have been found to exhibit higher peel performance when mated with some loop materials.

Figure 3:
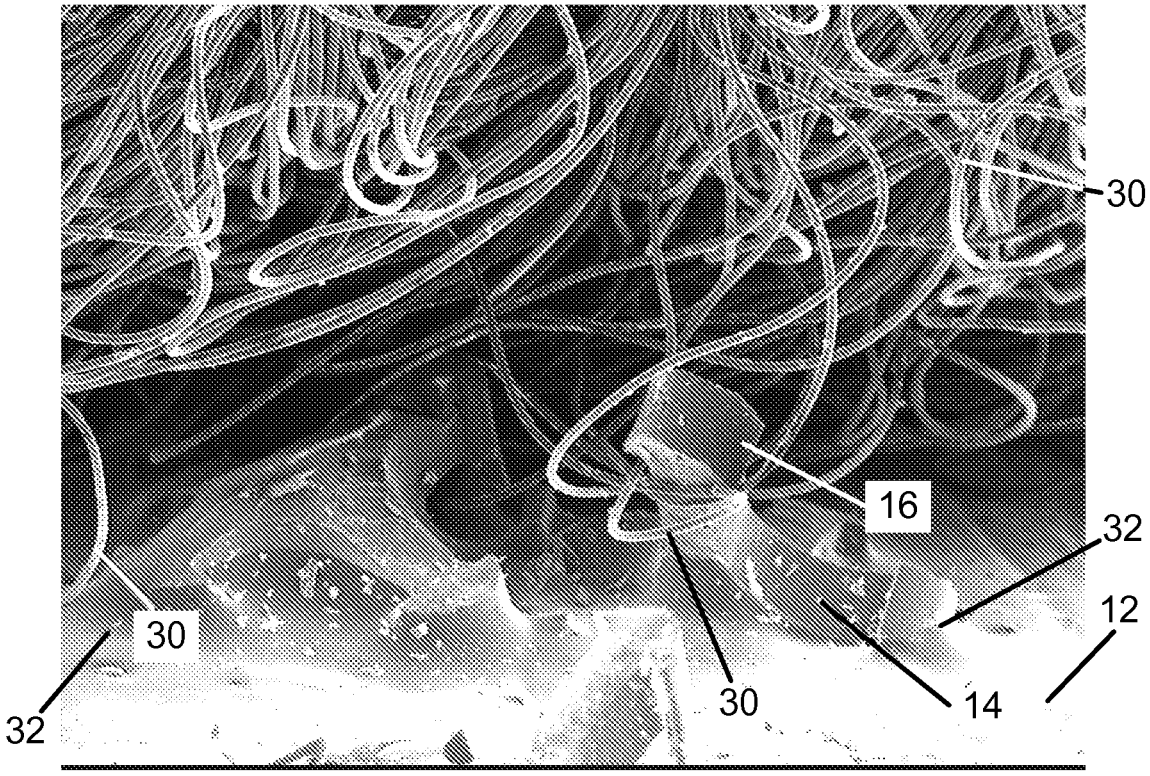
FIG. 3 is an enlarged photograph showing a few fastening bits of the surface of FIG. 1 engaging loop fibers of a mating fastener material.

Thus, as fixed to surface 12 and as shown in FIG. 3, each bit 14 is oriented with at least one of the projections 16 extending away from the support surface 12 for engaging loop fibers 30. In many cases, the projections themselves project at acute angles from the support surface 12, such that fibers may be snagged under the projection and/or in the crooks formed on either side of the projection. Furthermore, because the bits 14 are distributed randomly, the fastening properties of the overall touch fastener product are generally independent of engagement direction. For many touch fastener applications, the bits will be distributed with an average bit density of at least one bit per square centimeter, with all linear dimensions of the bit being less than about 1.2 millimeters. For some applications, bit densities between about 8 and 15 bits per square centimeter are preferable, with bits of such small size. For some other applications, bits as large as, for example, three millimeters across, are useful. While it may be, due to the random distribution of the bits, that some bits become fixed to the surface in contact with other bits, in most cases it is preferable that the bits be spaced from other bits so that the presence of other bits does not impede the engagement of fibers by the exposed projections.

As can be seen in FIGS. 2 and 3, each bit is permanently fixed to support surface 12 by an adhesive 32 into which lower portions of each bit are embedded. While the degree of wetting on the surfaces of the bits, and the amount of each bit that remains exposed will vary, in this example most bits have three out of four projections directly adhered to surface 12, leaving only one projection 16 of each bit exposed for engagement. With some other bit shapes (to be discussed further below), more than one projection of each bit will, on average, remain exposed for engagement.

Figure 4:
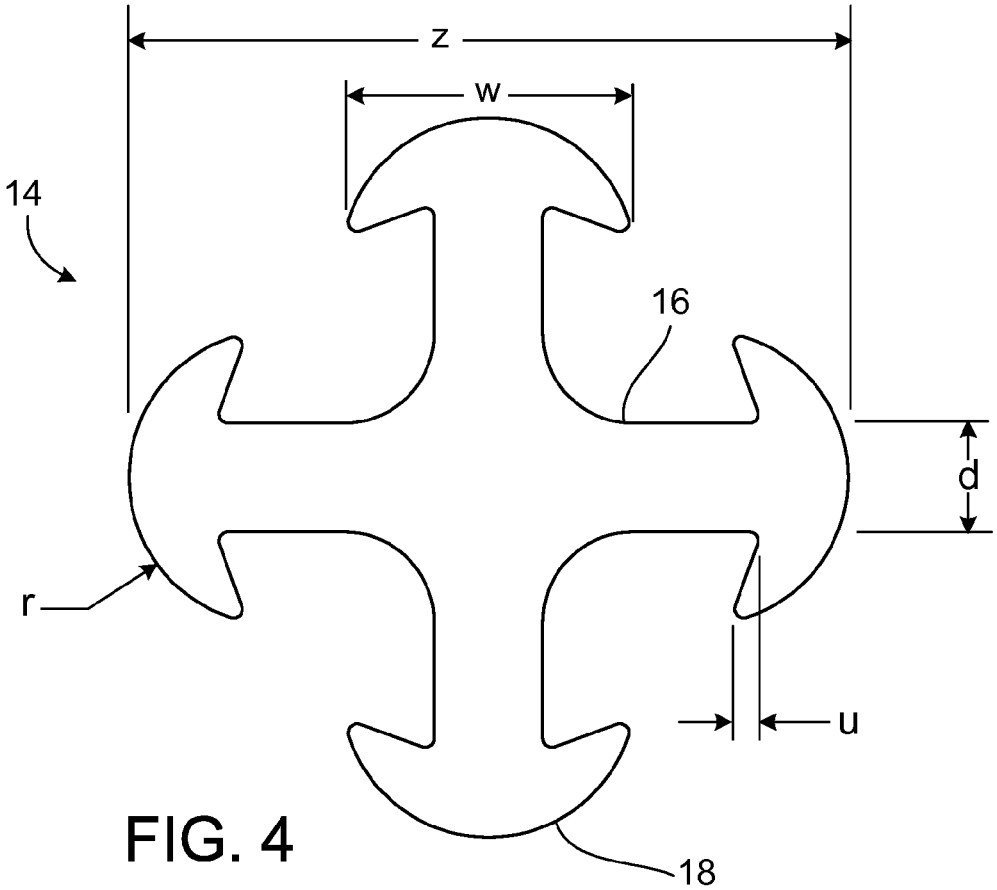
FIG. 4 is a front side view of a fastening bit.

The projected profile of each bit, as seen from one of its opposite side surfaces, is shown in FIG. 4. Each projection 16 ends at a head 18 that has an overall width 'w' of about 0.4 millimeter and a curved outer surface of radius 'r' of about 0.2 millimeter, overhanging a projection neck of a width 'd' of about 0.15 millimeter. The underside of each head forms two opposite loop-retaining crooks, the edges of each head extending back toward the bit a distance 'u' of about 0.033 millimeter. The maximum lateral dimension 'z' of the bit, measured from outer head surfaces, is about 1.02 millimeter.

Figure 4A:
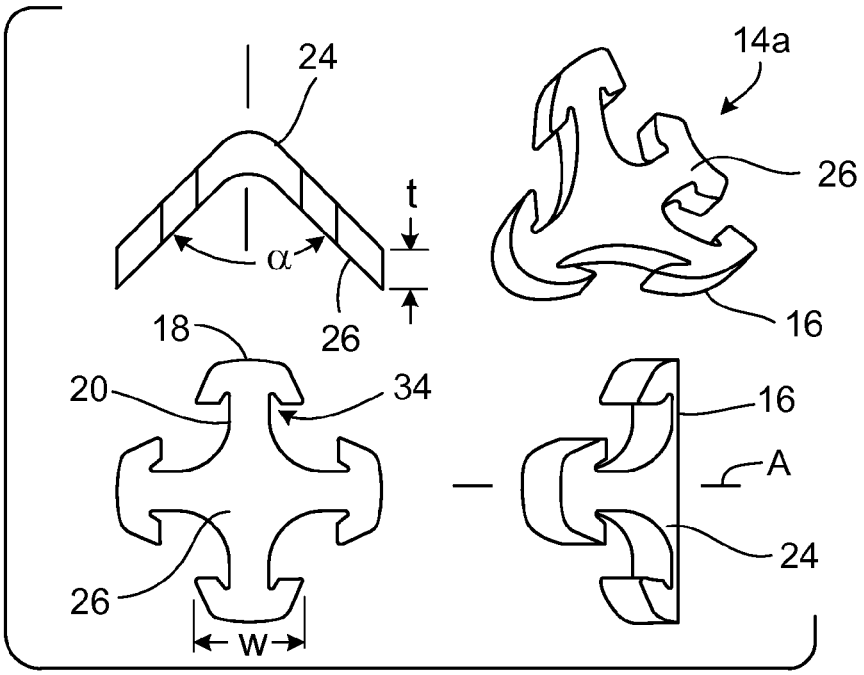
FIG. 4A shows three orthogonal and one perspective view of another fastening bit.

Referring next to FIG. 4A, the non-planar opposite side surfaces 24 and 26 of bit 14*a* are of complementary topography, such that two identical such bits will nest, with an opposite side surface 24 of one bit nestled against an opposite side surface 26 of the other bit. The other surfaces of bit 14 are all surfaces 28 that extend between the opposite side surfaces 24 and 26 and parallel to bit axis 'A'. In other words, for this particular bit design (and for some others discussed below), the volume of bit 14 may be formed by sweeping one of its non-planar opposite side surfaces 24 or 26 along the bit axis 'A' a distance 't' equal to the bit thickness. Side surface 26 of bit 14 may be said to be concave, and side surface 24 convex. It will be appreciated that not all portions of either opposite side surface 24 or 26 are curved, however, as can be seen in the upper left quadrant of FIG. 4A, which illustrates that in one side view, bit 14*a* can be said to be L-shaped, such that two of the projections 16 have generally planar sides, while the other two projections have curved sides. The root of each projection features a generous fillet with a radius of about 0.13 millimeter, to help avoid projection root fracturing. The projection heads each have an overall width 'w', measured from tip to tip, of about 0.38 millimeter. While the bit 14*a* of FIG. 4A is shown to define an included angle $\alpha$ on its concave side of about 90 degrees, it has been found that in many cases the severed bits tend to 'open up' after cutting, such that if an included angle of 90 degrees is desired, the rail may have to be severed at a corresponding angle of less than 90 degrees. The bit 14 shown in the foreground of FIG. 2, for example, was severed with a 90 degree cutter and has splayed or opened to have an obtuse included angle.

If bit 14*a* of FIG. 2 were fashioned as shown, but with its opposite side surfaces 24 and 26 planar and parallel, such a bit would tend to self-orient when falling against a horizontal surface with one or the other of its planar sides lying flat on the surface, with none of the projections extending upward for loop engagement. The shape of bit 14*a*, as with other bit shapes discussed below, is such that the bit will tend to self-orient with at least one projection exposed for engagement. By exposed for engagement and extending away from the surface we do not mean that the projection necessarily extends perpendicular to the surface, but simply that the head of the projection is raised from the surface and available for loop engagement. In some cases, as discussed below, only one of the opposite side surfaces is non-planar and the other of the opposite side surfaces is planar, with the non-planar opposite side surface defining a projection that extends away from the planar opposite side surface, such that if the bit falls with its planar side surface lying flat the projection extending from the non-planar side surface will extend upward for loop engagement.

It will be noted that bit 14*a* shown in FIG. 4A differs from the bits 14 shown in FIGS. 1-4 in the shape of the heads 18 of the projections, the undersides of the heads of bits 14 of FIG. 4A defining more aggressive undercuts 34 against the projection necks 20. Otherwise, bits 14 of FIG. 4A are of substantially similar shape and size to bits 14 of FIGS. 1-3. The tips at the edges of the heads are preferably of a radius of only about 0.013 millimeter, preferably even less. Similarly, the undercuts 34 against the projection necks, which act as loop traps, are also preferably of a radius of 0.013 millimeter or less.

Figure 5A:
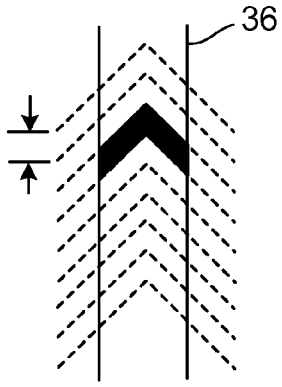
FIGS. 5A-5D illustrate four different cut configurations for cutting bits from a rail.
Figure 5B:
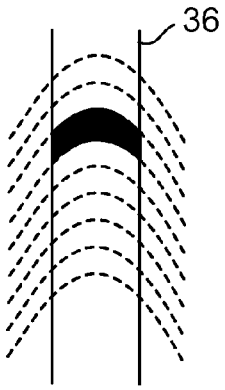
Figure 5C:
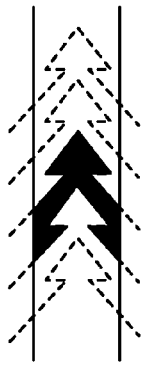
Figure 5D:
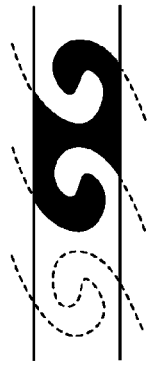

Bits of non-planar opposite side surfaces of complementary topography may be formed by cutting the bits from a shaped rail with a series of identical cuts, each cut simultaneously forming an opposite side surface 24 of one bit and an opposite side surface 26 of another bit. Examples of such cut sequences are shown in FIGS. 5A-5D, in each of which the elongated rail 36 from which the bits are cut extends vertically, each cut made perpendicular to the elongated rail is shown as a dashed line, and one bit is formed between each adjacent pair of cuts. Because the cuts are identical, the cuts in each sequence may be made by a single cutter cycled through the rail as the rail is advanced along its longitudinal axis a distance 't' between each cut, such that 't' also corresponds to the thickness of the severed bit. FIG. 5A illustrates cutting with a cutter having a pointed cutting profile, the apex of which is aligned with the center of the rail. FIG. 5B illustrates cutting with a cutter having a cutting profile that defines a smooth curve perpendicular to a longitudinal axis of the rail, such that each cut forms a concave rail end surface. FIGS. 5C and 5D illustrate cutting profiles that overlap themselves along the longitudinal axis of the rail, such as to form more complex projection head shapes.

Figure 6A:
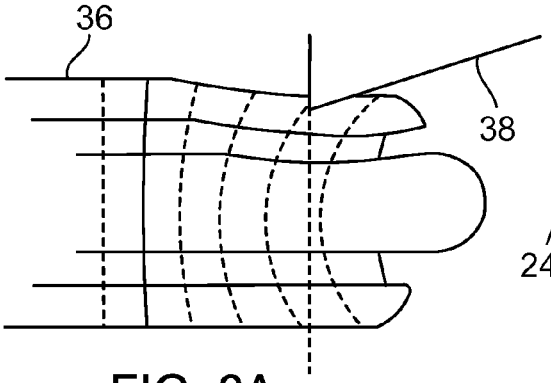
FIG. 6A illustrates rail deformation during cutting, as viewed from the side.
Figure 6B:
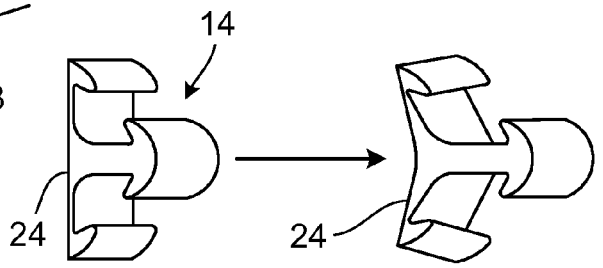
FIG. 6B shows bit curvature induced by rail deformation during cutting.

The rail shape and material resiliency may be chosen such that the process of cutting bits from the rail imparts further geometric properties. For example, FIG. 6A is a side view of a shaped rail undergoing a series of vertical cuts. The bold dashed line represents the path of the apex of a cutter 38 shaped as in the cut sequence of FIGS. 5A-5D, moving from top to bottom in FIG. 6A. As the cutter enters the material, force from the cutter compresses the material of the rail, which remains compressed during cutting. The lighter dashed lines of FIG. 6A illustrate the flexure of the rail 36 due to the cutter-induced compression. Because the rail material is resilient, after a bit is severed from the rail its severed surface 24 obtains a curvature perpendicular to the path of the cut, due to relaxing of the compressed bit material, as illustrated in FIG. 6B. Thus, curvature in one plane can be provided by cutter shape, while curvature in a perpendicular plane can be provided by compression during cutting, and curvature in yet another perpendicular plane can be provided by rail shape. In this manner, bit geometry may be altered in essentially any orthogonal direction.

Furthermore, the resulting geometry of each cut can be modified by adjusting the unsupported length of rail extending between the end of its support surface and the cutter. For example, spacing the cutter wheel so as to engage the rail beyond the end of its support will cause the unsupported length of rail to be resiliently deflected during cutting by bending forces induced by the cutting, such that, after the cutting, the unsupported length of rail returns to a position, prior to a subsequent cut, in which an edge of the rail corresponding to an exit point of the cutting extends farther in a longitudinal direction than an edge of the rail corresponding to an entrance point of the cutting. However, for many applications it may be preferable to reduce or eliminate any unsupported length of rail during cutting.

Figure 7A:
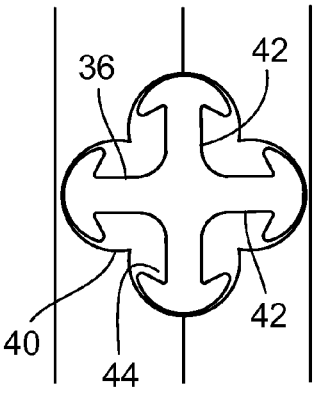
FIGS. 7A-7C sequentially show a process of cutting through a rail.
Figure 7B:
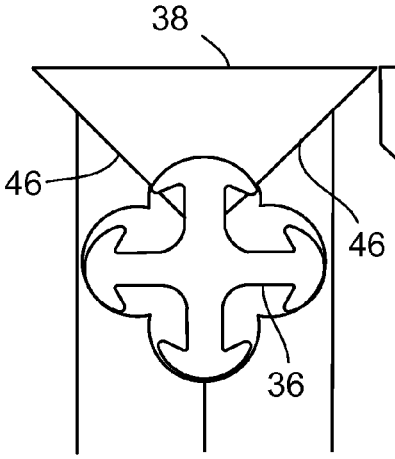
Figure 7C:
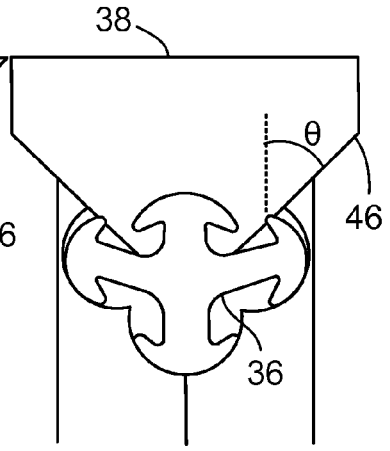

FIGS. 7A-7C sequentially illustrate progression of a cutter 38 through a shaped, extruded rail 36 supported within a groove 40 defined between two plates. FIG. 7A shows the relaxed shape of rail 36, shaped with four longitudinal ribs 42 so as to form bits having four perpendicular projections as shown in FIGS. 1-3, each rib defining undercuts 44 that correspond to the crooks of the bit heads. Groove 40 is shaped and sized to allow rail 36 to be advanced along the groove between successive cuts, but with minimal clearance at the rib heads and so as to disallow rotation of the rail during cutting. FIG. 7B shows the cutter 38, in this case a pointed cutter with a solid cutting edge having an apex aligned with the center of the rail, advanced almost completely through the uppermost rib 42, which is in a state of vertical compression. The shape of cutter 38 shown in this sequence results in much of the rail material being sliced by the acutely-angled cutting edges 46 on either side of the cutter, without inducing a net lateral load on the rail during cutting. In end view, cutting edges 46 each form an acute cutting angle θ with respect to the direction of cutting, each cutting edge 46 shearing through the rail toward a lateral rail edge as the cutter 38 advances through the rail 36. FIG. 7C shows the cutter advanced nearly completely through the center web of the rail, with the material of the severed upper rail rib remaining compressed due to shear loads against the face of the cutter and due to the very rapid speed of cutting. The vertical compression of the rail also tends to compress the lower rail rib and distort the side ribs, as shown. As the cutting edge of cutter 38 progresses completely through rail 36 at discrete intervals along the rail axis (extending out of the plane of the figure), discrete and separate fastening bits are formed, with the cutting forming the opposite side surfaces of each bit, the fastening projections of each bit formed of severed rib segments of the rail. A high tolerance for strain before yield is considered a desirable property for rail materials.

Figure 7D:
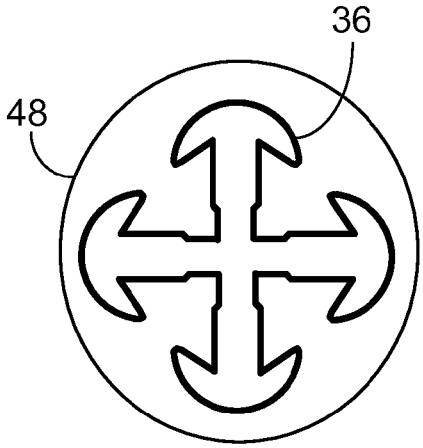
FIG. 7D is an end view of a rail encased in a stabilization material.

Rail deformation during cutting can be reduced, if desired, by forming a stabilization layer around the ribs prior to cutting. FIG. 7D shows a rail cross-section in which the rail 36 is encapsulated in a stabilization material 48. Examples of a rail stabilization material include lower melting point polymers or starch that can be melted or washed from the severed bits to expose the projection-defining surfaces of the bit. Cutting through the stabilized rail 36 includes cutting through the stabilization layer 48.

Figure 8:
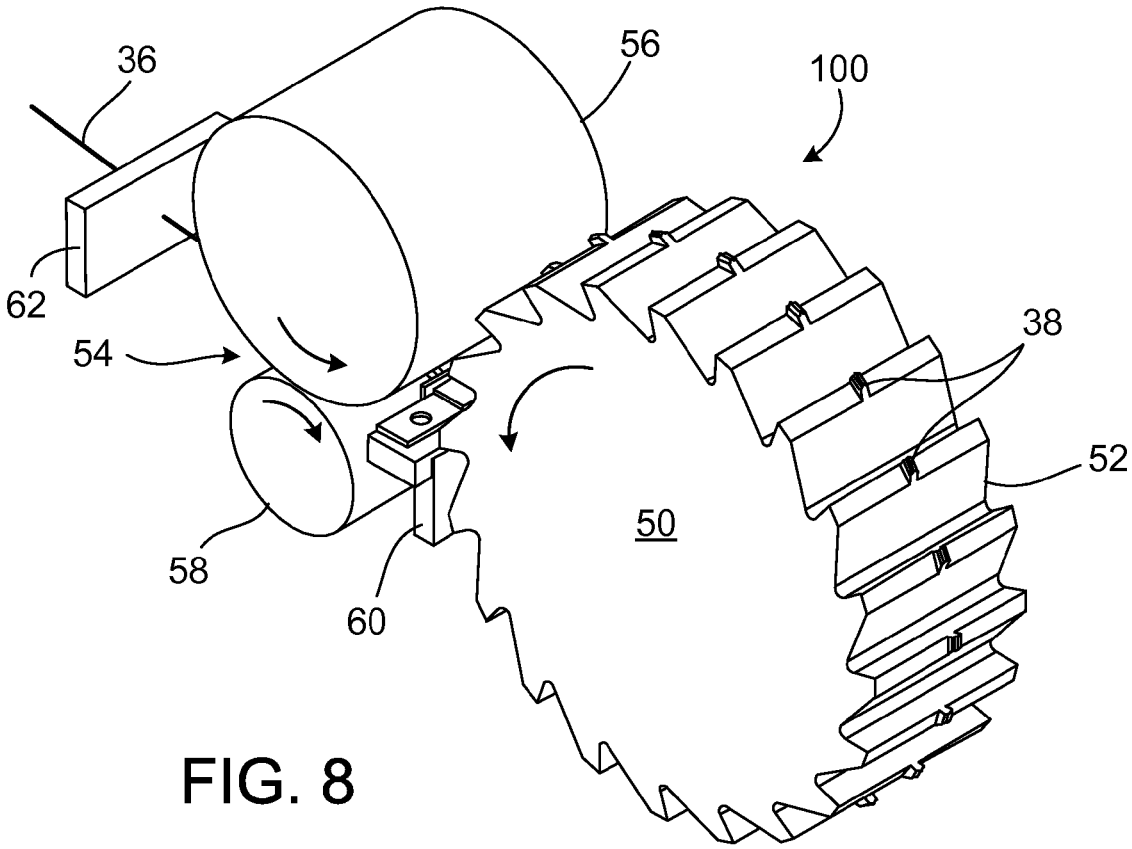
FIG. 8 is a perspective view of portions of a machine for cutting fastening bits from a continuous extrusion.

While the cutting patterns described above may be performed by linear reciprocation of a cutter blade, they may also be formed by a rotating cutter wheel. Referring to FIG. 8, a toothed cutter wheel 50 has a series of teeth 52 about its periphery, and each tooth is shaped to form a cutter 38 at a distal end of a protrusion extending from the tooth. The radius of the path traced by cutter 38 is sufficiently large, as compared to the vertical dimension of the rail, that the path of the cutter through the rail can be said to be substantially linear. The extruded rail 36 is fed toward cutter wheel 50 through a nip 54 between a pair of counter-rotating feed rolls, including an upper feed roll 56 and a lower feed roll 58. The rail is supported during cutting by a bed knife 60.

Figure 8A:
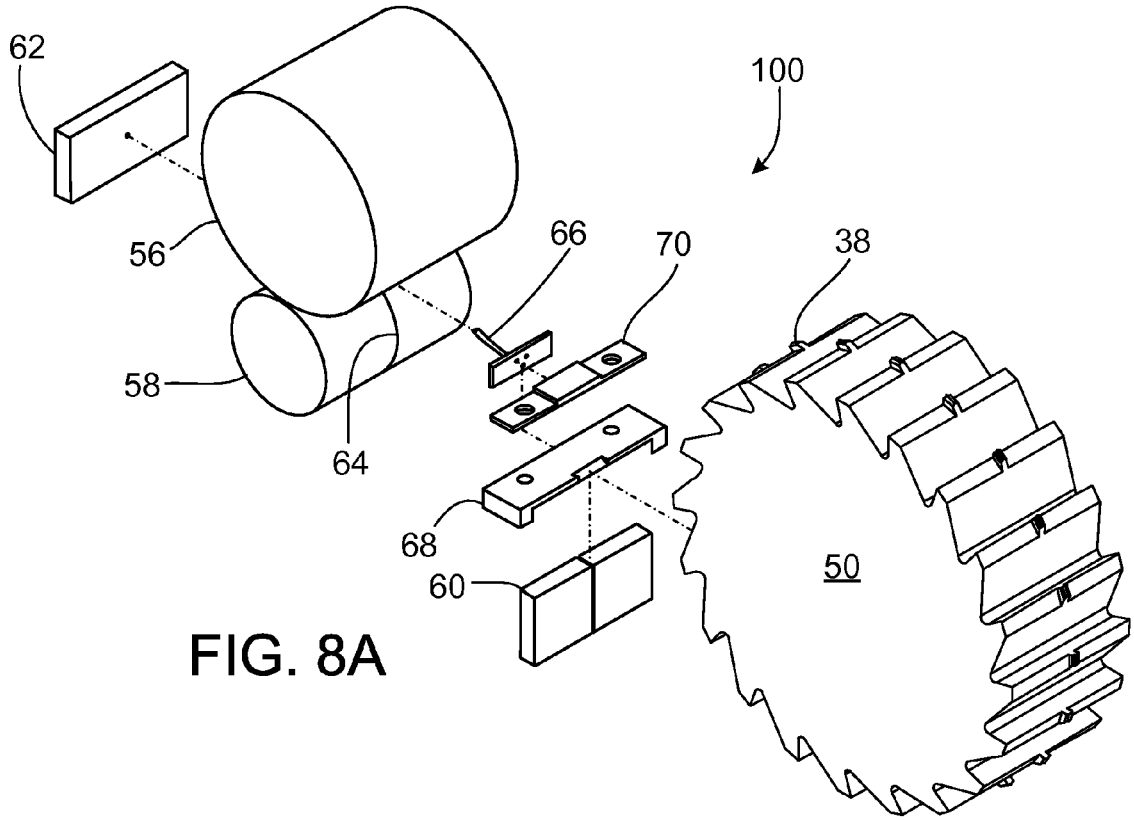
FIG. 8A is an exploded view of the machine components of FIG. 8.
Figure 10A:
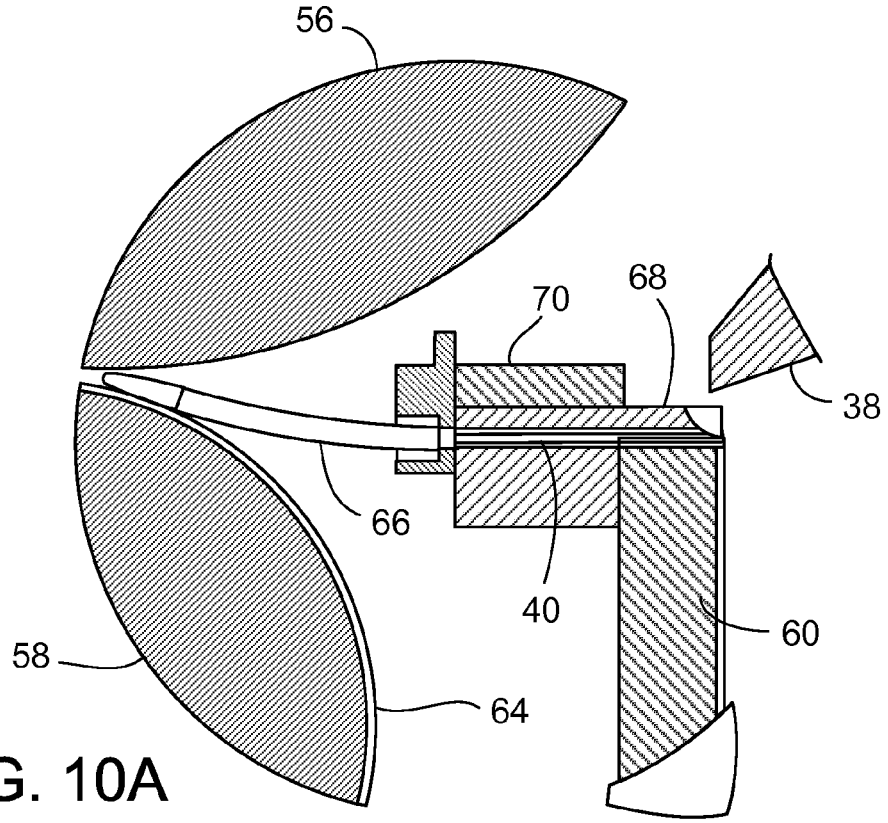
FIG. 10A is a cross-sectional view, taken through the extrusion travel path from the feed nip to the cutting plane.
Figure 10B:
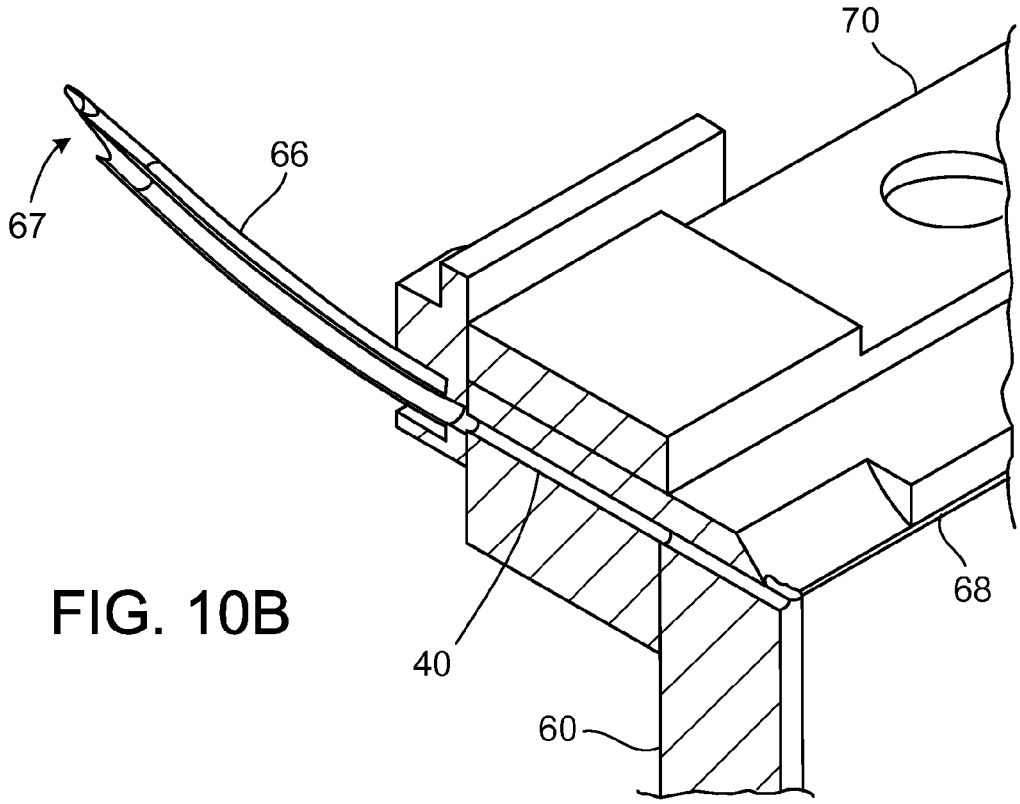
FIG. 10B is a sectioned view showing the rail support structure.

Referring also to FIG. 8A, lateral alignment and rotational orientation of the rail is maintained by a pre-alignment bushing 62, a groove 64 defined about the circumference of lower feed roll 58, a hollow transfer tube 66 through which the rail travels on its way to a rail guide groove defined between the upper surface of bed knife 60 and a lower surface of bushing 68. In some instances, upper feed roll 56 also defines a groove, aligned with groove 64 in the lower feed roll, for accommodating the rail. The aperture in bushing 62 is sized so as to halt the progress of the rail if any extrusion defects are encountered that would not readily pass through the rest of the machine, and may be tapered at its entrance to facilitate feeding a new rail into the machine while running. Although illustrated as a flat surface, the exit side of bushing 62 may be shaped so as to place the bushing in very close proximity to both feed rolls, such that the end of a new rail fed into the bushing will be directed into any groove of the feed rolls while they are rotating. A transfer tube attachment bracket 70 holds the transfer tube securely in place with respect to the bed knife. The lower feed roll 58 is a relatively rigid roll, with an outer surface of stainless steel, while the upper feed roll 56 has a compliant outer surface, such as of Hypalon® (formerly available from DuPont) or similar material, that engages the rail and feeds it into the transfer tube 66, which, as shown in FIG. 10A, extends as far as practical into the nip between the two rolls, so as to prevent buckling of the rail by the feed action of the rolls, which continues throughout the cutting process, even while the cutters temporarily prevent the advance of the end of the rail. Preferably, the transfer tube has an entrance positioned such that any unsupported portion of the rail between the feed rolls and the transfer tube is of a length less than twice a maximum lateral dimension of the rail. As shown in FIG. 10B, the entrance end 67 of the tube is shaped with relief both top and bottom to accommodate the feed rolls, such that the unsupported length of rail is roughly the same or less than the rail width. Although groove 40 is shown as below the elevation of the nip between the feed rolls, in some cases it is aligned vertically with the nip, such that the rail does not alter its direction or undergo any bending as it passes from feed nip to cutter wheel.

As an example of workable dimensions for processing a rail of thermoplastic resin having a maximum lateral dimension of 1.02 millimeters, transfer tube 66 has an inner diameter of 1.27 millimeters, and the groove 40 that rotationally aligns and supports the rail at the upper surface of bed knife 60 has a lateral dimension of 1.12 millimeters (i.e., a working nominal clearance of only about 0.05 millimeters on either side of the rail). Bed knife 60 is also grooved on its face facing the cutter wheel, as shown in FIGS. 10A and 10B, to provide clearance for the cutters and to assist in the alignment of the equipment. As shown in FIG. 10B, the bushing 68 is relieved at the exit of groove 40, such that the upper portion of the rail is exposed while the underside of the rail remains supported by the shaped upper surface of the bed knife forming the lower portion of groove 40. The surfaces against which the rail slides may all be plated, polished or otherwise treated to avoid or reduce friction coefficients as against the rail material. Furthermore, movement of the rail along its path may be assisted by flowing a rail carrier, such as air or water, along the path with the rail. Such a rail carrier may be, for example, a lubricant selected to facilitate severing or prolong cutter life, and may be caused to flow at such velocity that it helps to propel the rail forward toward the cutting wheel. Alternatively, the rail may be lubricated by a coating applied to the rail, or by a liquid lubricant spray or bath. These rail feed surfaces may also be cooled or heated, to decrease or increase the temperature of the rail prior to cutting.

Bed knife 60 may be formed of a much harder, wear-resistant material than cutters 38 of the cutter wheel, such that final shaping of the cutters may be performed by running the spinning cutter wheel into contact with the bed knife, or adjusting the bed knife toward the cutter wheel, the bed knife groove forming a complementary shape to the cutters. The cutter wheel may be left in such a position with respect to the bed knife during rail cutting, such that rail cutting is done with essentially a zero-clearance or line-to-line positioning of cutters and bed knife. Similarly, to accommodate cutter wear during use, the position of the cutter wheel may be adjusted toward the harder bed knife to "re-form" the cutter surfaces and prolong the useful life of the cutters. The bed knife may be formed of carbide, for example, and the cutters of 303 stainless steel. The channel on the upper surface of the carbide bed knife that forms the lower part of groove 40, and the groove on the front face of the bed knife, may both be formed by a wire-EDM process.

The cutter wheel is positioned vertically with respect to the exit of groove 40 such that the rail engages the cutter at an elevation slightly below the rotational axis of the cutter wheel. This causes the rail to be offset very slightly from the rotational axis of the wheel in a forward sense with respect to the direction of rotation, such that the cutters enter and exit the rail at slightly different axial positions along the rail and the rail is maintained under some tension during each cut. Preferably, however, the cutters move along a circular path that has a radius at least 40 times a distance that each cutter cuts through the rail, such that this difference in axial variation during each cut is very small.

In one example, a six inch (15 centimeter) diameter cutter wheel 50 was rotated at 3000 rpm, achieving an effective linear cutting speed of 2,400 centimeters per second through the rail. With 32 cutters about the cutter wheel, this achieves a production speed of about 1,600 bits per second (bps) from a single rail. Achieving a bit thickness of 0.3 millimeter at such speed requires advancing the rail at a rate of about 49 centimeters per second. A similar process with only 4 cutters about the wheel would require a rail advance rate of only about 6 centimeters per second (12 feet per minute).

The pelletizer 100 of FIG. 8 may be incorporated into a larger machine for producing a fastener product. For example, the machine 102 of FIG. 9 includes an extruder 104 that accepts a supply of resin chips (not shown) and extrudes molten resin under pressure through a die to form shaped rail 36, which is then fed through a water bath 106 and an air knife 108 into pelletizer 100. Substrate 12 is simultaneously unwound from a spool and coated with adhesive 32 by applicator 110. While the adhesive is tacky, the substrate passes beneath the output chute of pelletizer 100, such that the severed bits 14 are distributed onto the adhesive, where they land in a variety of orientations, with one or more engageable projections extending from the adhesive surface. The substrate, carrying the adhesive and bits, then passes through a curing station 112 in which the adhesive is cured, such as by cooling or radiation.

Figure 11A:
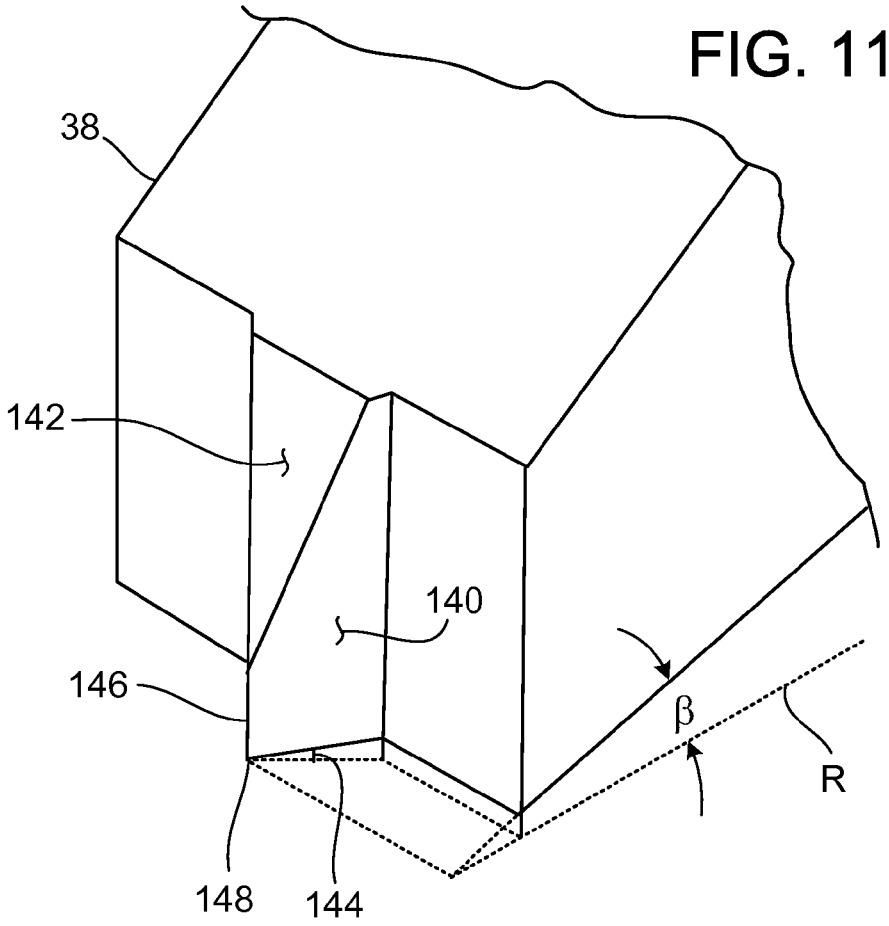
FIG. 11A is a perspective view of a distal end of a cutter.
Figure 11B:
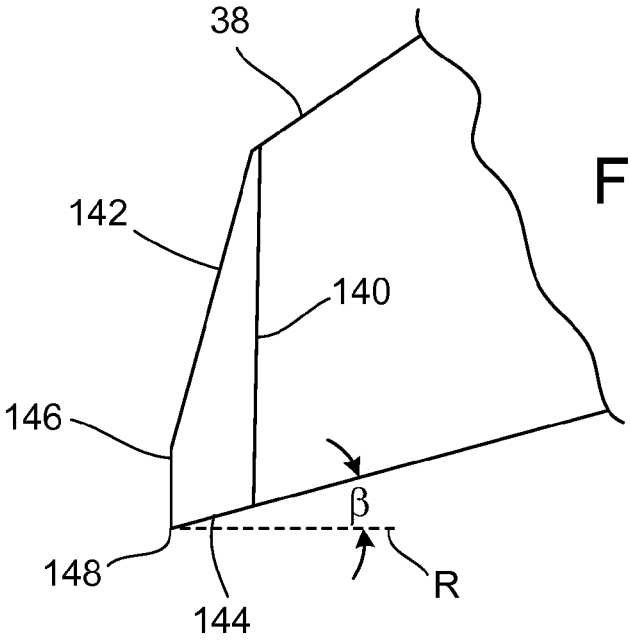
FIG. 11B is a side view of the cutter of FIG. 11A.

FIGS. 11A and 11B show the detail of a cutter 38, which is formed to have a pointed projection 140 that engages and severs the rail. The trailing portion of projection 140 has a wedge-shaped relief 142, and the leading edge 144 of the projection defines a rake angle β with a radius R of the cutting wheel, such that the point 148 defined at the intersection of the radially distal edge 146 of the projection and the leading edge 144 of the projection leads the cutter in its rotation. Distal edge 146 is shown essentially perpendicular to the cutting wheel radius from point 148 to the beginning of relief 142. Rake angles of about 20 to 25 degrees have been found to be appropriate with polyester rails. While this cutter 38 is shaped with an outwardly-directed projection for forming concave cuts in the rail, cutting may also be performed by a cutter defining a recess, such that the rail is first engaged on either lateral side by the advancing edges of the walls defining the recess. Such a cutter shape may help to trap the rail end as it is severed, forming convex surfaces on the exposed rail end.

Figure 9:
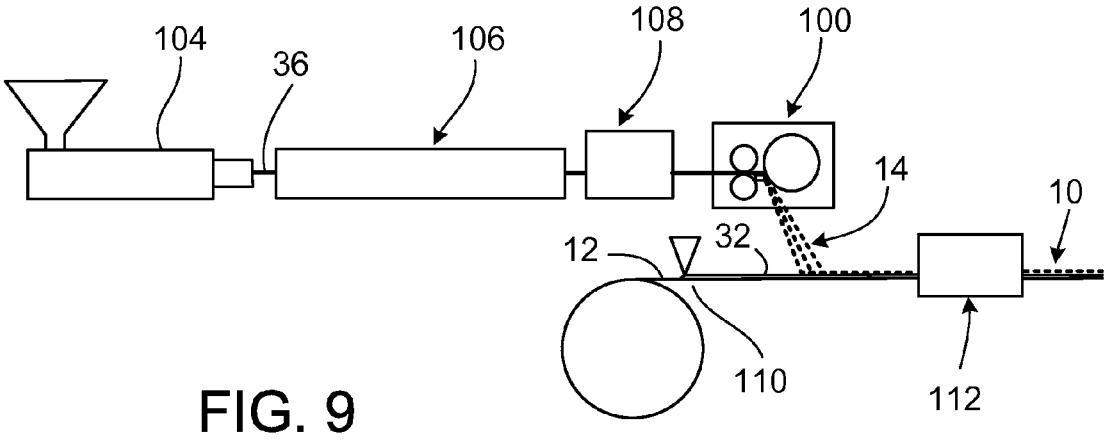
FIG. 9 is a schematic representation of a machine and process for converting bulk resin pellets, adhesive and a substrate into a fastener product.
Figure 10C:
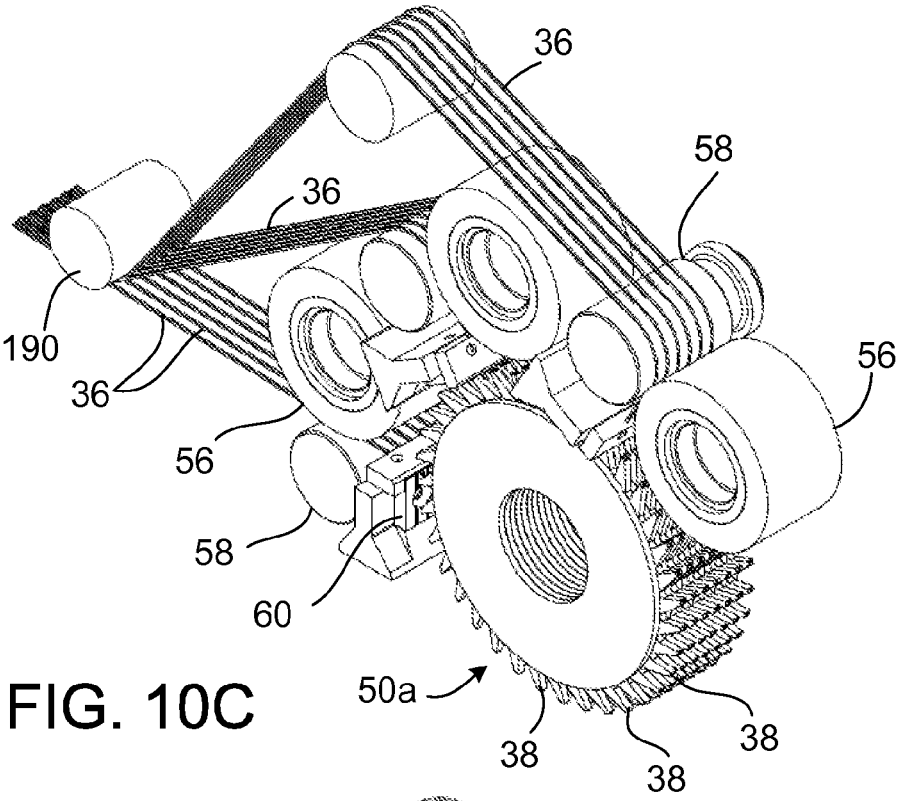
FIGS. 10C and 10D illustrate a rail cutting machine in which multiple rails are fed to a single cutter wheel.
Figure 10D:
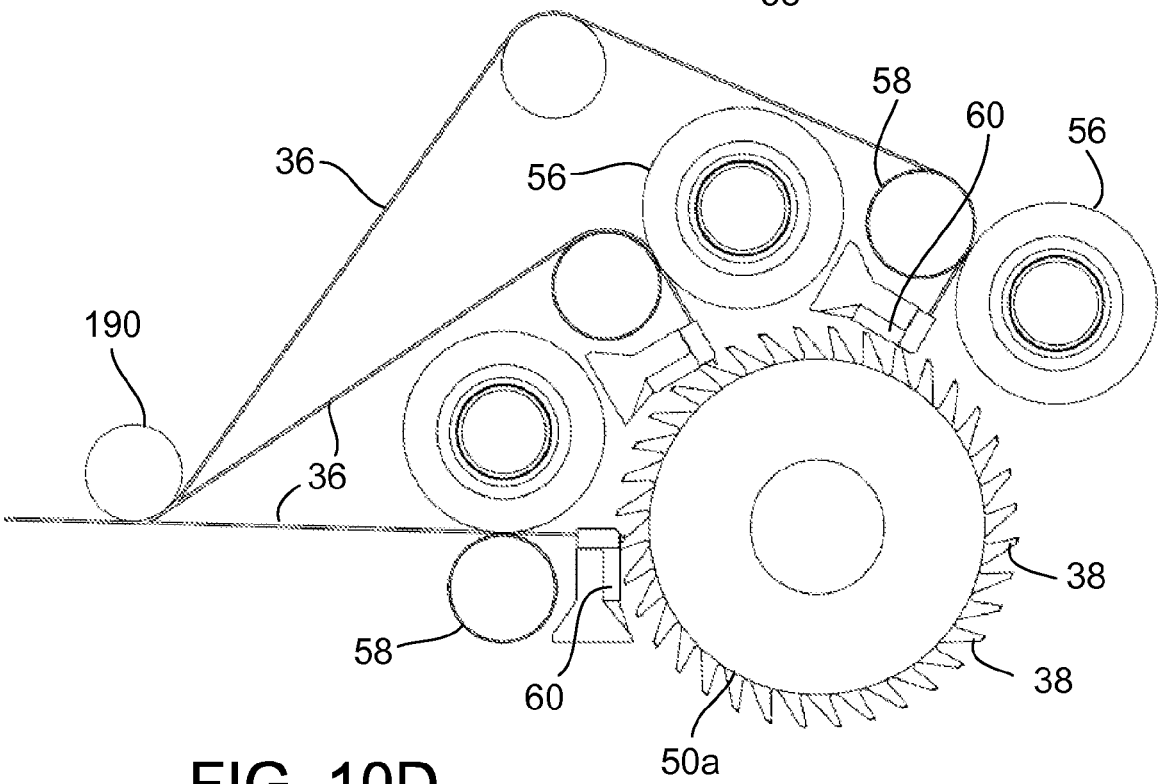

Although the machines of FIGS. 8 and 9 are illustrated as configured to process only a single extruded rail at a time, other machine examples are configured for processing multiple rails. For example, FIGS. 10C and 10D illustrate a configuration for feeding multiple banks of rails 36, spaced apart along the circular path of the cutters, to a wheel 50*a*, such that each cutter 38 cuts through multiple rails in each revolution of the wheel. In this example there are three banks of rails, each bank corresponding to a separate bed knife 60 and drive wheels 56 and 58. The banks are separated from one another after passing over an idler 190. As illustrated, each bank of rails consists of multiple rails 36 fed in parallel through corresponding bed knife grooves, to corresponding cutters 38 aligned with the bed knife grooves and mounted on a single cutter wheel 50*a* that is formed as a compressed stack of concentric cutting plates, each plate carrying a respective series of cutters 38 that are spaced from the cutters of adjacent cutting plates so as to be aligned with the grooves of the bed knives 60. The cutting plates may be held in alignment about a mandrel (not shown), and spaced apart with shims for proper axial spacing. Although not shown in this illustration, the rails are supported in respective transfer tubes between the drive wheels and bed knives, as discussed above with respect to FIG. 10B.

With more densely configured cutting processes, it can be useful to supply a strong flow of air, such as in a direction coinciding with the axis of the cutting wheel, to blow the severed bits away from the cutting wheel so as to not interfere with the cutting of other rails or to be further severed by other blades.

In such a manner the basic process illustrated in FIG. 9 may be multiplied within a single machine to greatly increase bit production. For example, operating at the same cutter wheel speed, diameter and tooth spacing, feeding three banks of 20 rails in each bank would produce almost 100,000 bps, or enough bits every minute to cover one square meter of fastener product at an average distribution of 10 bits per square centimeter (or a length of 200 meters of 30 centimeter wide fastener tape every minute). Even higher production rates per machine may be achieved with more cutters about the wheel, higher wheel diameters, and more rails being engaged per wheel rotation. A single bit-cutting or pelletizing machine may be configured to process anywhere from 1-100 rails simultaneously, at cutter wheel speeds of anywhere from 500 to 4000 RPM, and from 4-120 cutters spaced around the circumference of the rotary cutter wheel, producing up to 800,000 bps, per machine.

After being severed, the bits may be collected in a bag or other container, such as through an exit chute into which the bits fall from the cutting wheel. In cases where some dust or other smaller particles are generated during pelletizing, such dust can be separated from the bits prior to packaging, such as by elutriation. Elutriation may also be employed to separate different bit shapes or sizes, in cases where the cutting wheel is configured to produce different bit configurations. Dissipation of static charges remaining on severed resin bits following pelletizing may be accelerated by moistening the rails prior to cutting, such as by spraying them with a fine water mist.

Figure 12:
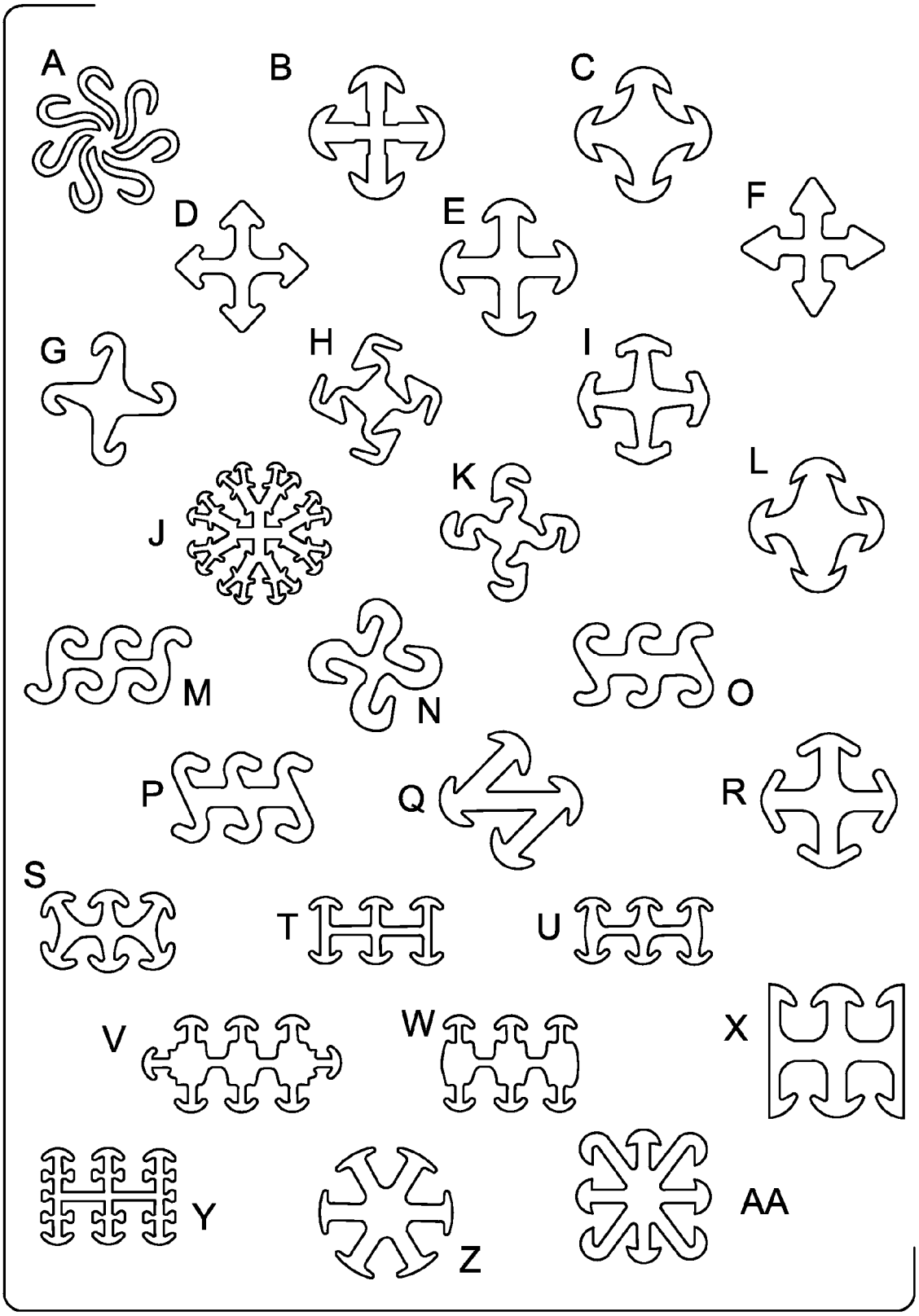
FIG. 12 shows 27 different rail cross-sectional shapes, from which bits may be cut, the shapes labeled A through AA.

FIG. 12 shows several examples of cross-sections that may be continuously extruded to form rails from which bits may be severed. Each cross-section shown in FIG. 12 represents a constant rail cross-section, with the outline of the profile representing the projection-defining surfaces that extend continuously along the length of the rail and maintain their as-extruded nature in the severed bits. Many shapes, like those labeled B-I, K, L, N and R, have four projections, each extending from a common hub generally perpendicular to two adjacent projections. In many of those, the projections are all identical. Shape L shows an example in which the projections are not all identical. Many, such as shapes B-F, I, L and R-Z, are symmetric about each of two axes (one vertical and the other horizontal as illustrated). Shape L, for example, is stiffer with respect to compression in the vertical direction, so as to withstand cutter load without buckling. Some, such as shapes M, O, P, S-W and Y, have both a major axis and a minor axis perpendicular to their longitudinal axis, with the cross-section longest along its major axis. With such shapes it is preferred that the cutting occur along the direction of their minor axis. Many of the shapes with major and minor axes of different dimensions have projection extending in only two opposite directions, such as in shapes M, O, P, T, U and W. Shapes S and Z each have six projections, each extending in a different direction, and shape AA has eight projections each extending in a different direction. Shape V is similar to shape W, but with the addition of projections extending from either end along the major axis. Shape Y has six primary projections extending in the direction of its minor axis, the neck of each primary projection carrying a pair of secondary projections extending in the direction of its major axis. Shape J has four primary projection groups, each group comprising several branches that form discrete projections, such that the outer periphery of the bit has 16 separate heads for engaging loop fibers, while additional features on the sides of the projection stems form even more engagement points. Many of the shapes have projections with heads that overhang their stems on both sides of the projection, such as those in shapes B-F, H-L, Q-W, Y and Z, and some of the projections of shapes X and AA. Other projections, such as those of shapes A, G and M-P, and some of those of shapes X and AA, have heads that overhang to engage fibers on only one side of their stem. In some shapes, such as shapes H and K, the projections each overhang in two directions, but at different distances along the projection, such that each projection defines two fiber-retaining crooks, one nearer the central hub of the bit than the other. In shape Z the heads overhang both sides of the projection stems to form crooks, but with no return of the tips of the head toward the hub of the bit, such that the underside surfaces of the heads are essentially flat and perpendicular to the adjacent projection stems surfaces. In shape Q projections extend at acute angles up and down from a central web (shown horizontal in the figure), the ends of which are also equipped with overhanging heads for loop engagement, such that the overall cross-section of the rail has the general appearance of a letter 'N' or 'Z'. This shape also provides for some vertical collapse during cutting, the upper and lower arms of the shape elastically compressing against the central web to support the arms during cutting. In most of the illustrated shapes the outer surfaces of the projection heads are rounded, while the heads of shapes D and F are generally pointed. The various projections shown in these shapes are designed to have particular engagement and disengagement properties. For example, the heads of the projections of shape Z are designed to snag very low-loft fibers, such as those of non-woven materials, while the heads of the projections of shape N are designed to engage with high-loft loops and to aggressively retain the loop fibers once engaged, without distending. Of course, many other rail shapes, and corresponding bit shapes, are useful.

Figure 13A:
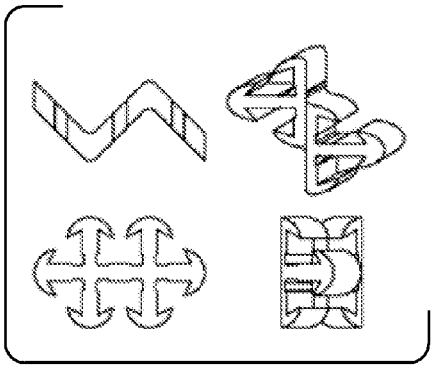
FIGS. 13A-13F show six different bit structures, each structure illustrated in one perspective and three orthogonal views.
Figure 13B:
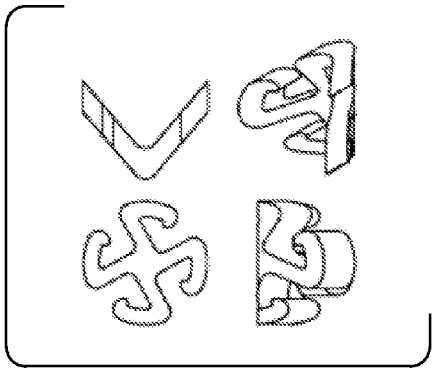
Figure 13C:
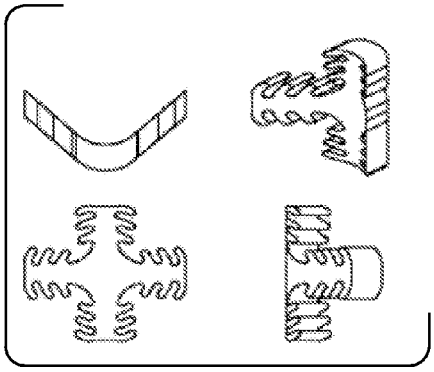
Figure 13D:
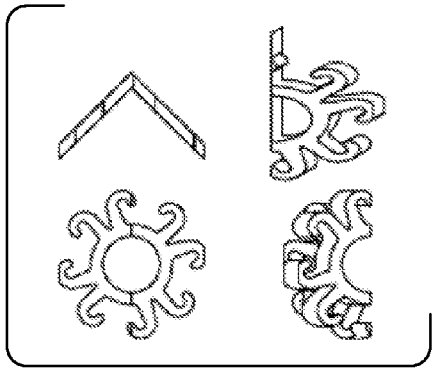
Figure 13E:
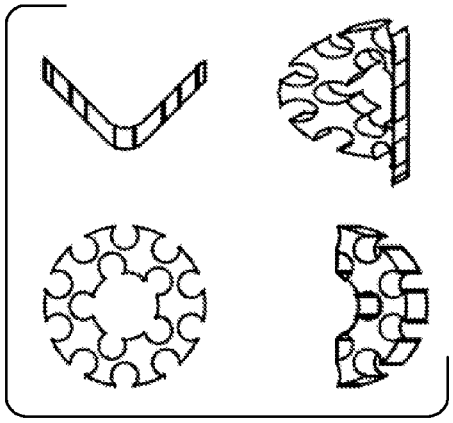
Figure 13F:
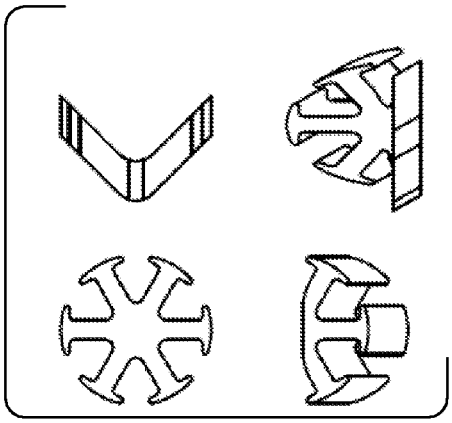

Rails of the various cross-sections discussed above can be cut with various cutter profiles to create non-planar bits of different configurations. FIGS. 13A-F illustrate six such structures. The bits of FIGS. 13B-F have all been cut with a cutter having a single bend or apex aligned with the centerline of the rail, such that in top view (shown in the upper left quadrant of each figure) the bit has a V-shape. The apex of the cutter may be sharp, resulting in little radius at the apex of the bit, such as in the bit of FIG. 13D, moderately radiused, as to produce the bits of FIGS. 13B, 13E and 13F, or more broadly radiused, as to produce the bit of FIG. 13C. The bit of 13A was produced by severing a rail (of cross-section essentially as shown in the lower left quadrant of FIG. 13A) with a cutter defining two interior bends or corners, such that the resulting bit has the wavy profile shown in the top view of the upper left quadrant of the figure. The bits of FIGS. 13A-E are severed from rails of different cross-section than those shown in FIG. 12, while the bit of FIG. 13F was severed from a rail having the cross-section according to shape Z of FIG. 12. The bit of FIG. 13E is cut from a hollow rail, the inner surface of the rail shaped to form projections extending inward from the body of the bit, while the outer surface of the rail is shaped to form projections extending outward from the body of the bit. But the inwardly- and outwardly-extending projections have overhanging heads that only barely overhang on either side, but enough to snag fibers. It will be understood that each of the bits of FIGS. 13A-F will tend to self-orient, when falling on a horizontal surface, with at least one of its projections raised from the horizontal surface, and in many cases extending away from such surface, for loop fiber engagement. The bit of FIG. 13E will tend to have both inwardly-extending and outwardly-extending projections raised for loop fiber engagement, as supported on a horizontal surface. These are but examples of bit configurations useful for forming touch fastener products. The rail shapes shown in FIG. 12 (and in the lower left quadrants of each of FIGS. 13A-F) may be cut with any of the cutting profiles shown in FIGS. 5A-5D, or discernable from the bit structures of FIGS. 13A-F, or otherwise non-planar) to create significantly more examples of bit structures than can be readily discussed or illustrated here.

Radial orientation of cutting profile to rail cross-section is important for some combinations of cutting profiles and rail cross-sections, in order to avoid stable bit orientations in which there are no raised engageable heads. For example, if one were to form the bit of FIG. 13B, but with the rail rotated 45 degrees, such that the apex of the cut passed between adjacent projections, the resulting bit would have a stable orientation resting on a horizontal surface supported on its four heads, with the concave side down. This illustrates a more general concept that, for a cutting profile having but one apex, the bit should be cut such that its heads are not all equidistant from the cutting profile apex. Thus, when cutting a cross-shaped rail, for example, the rail is preferably oriented as shown in FIGS. 7A-7C, with two of its projections aligned with the direction of cut. However, some rail cross-sections are not as particularly orientation-dependent. For example, the axisymmetric cross-sections of the rails severed to produce the bits of FIGS. 13E and 13F need not be constrained to a particular radial orientation during cutting, and can be supported in a simple round groove. Rails having a major and minor axis, such as the rail from which the bit of FIG. 13A is cut, are preferably cut in the direction of their minor axis.

Figure 14A:
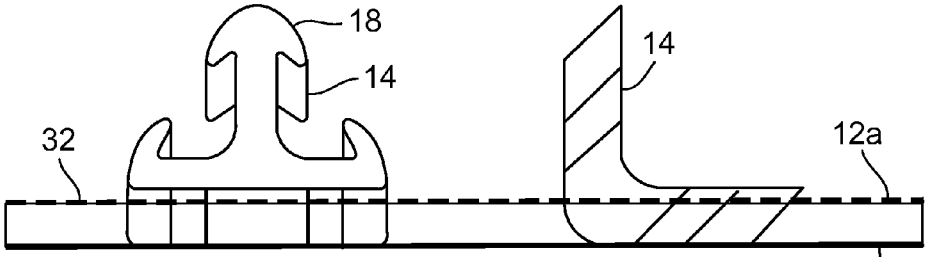
FIGS. 14A-14E show, in side view, five different stable bit orientations upon a surface.
Figure 14B:
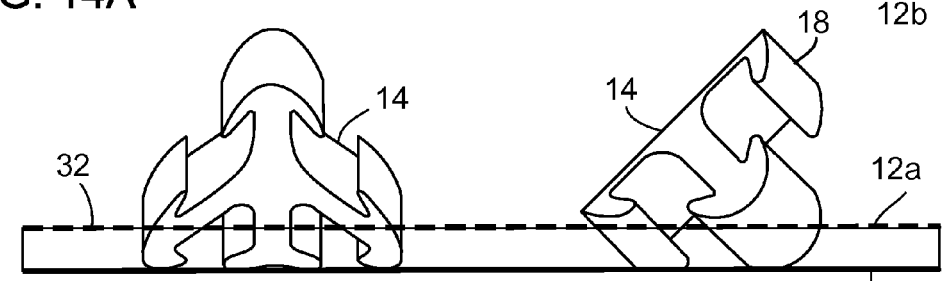

Referring next to FIGS. 14A-E, when bits 14 are randomly distributed over a horizontal surface 12, and rest on that surface only under their own weight, they may assume any one of the orientations shown in these figures. All of these orientations have in common that at least one projection head 18 of the bit is raised from surface 12 for loop fiber engagement. In the orientation shown in FIG. 14A, the bit is resting on a portion of its convex side surface, with one projection flat against surface 12 and the heads of two other projections in contact with surface 12. One projection extends away from surface 12, its head 18 fully raised or spaced from surface 12 for loop fiber engagement. Because the convex side surface of bit 14 defines essentially a 90-degree angle, the upwardly extending projection extends essentially perpendicular to surface 12. In the orientation of FIG. 14B, bit 14 is resting on three of its projection heads, with the fourth projection head 18 extending away from, and raised from, surface 12 for fiber engagement. Due to the shape of the bit, the upper projection extends at an acute angle to the surface. As seen from FIGS. 1-3, when broadcast over a surface many of the bits assume this particular orientation. In general, the shape and structure of the bits are stable as cut, prior to being distributed onto the surface. The bits are not applied to the surface in liquid form, nor do they obtain their individual shape by influence of gravity or the surface itself. In this sense they may be considered rigid bodies in comparison to the adhesive bonding them to the surface.

Figure 14C:
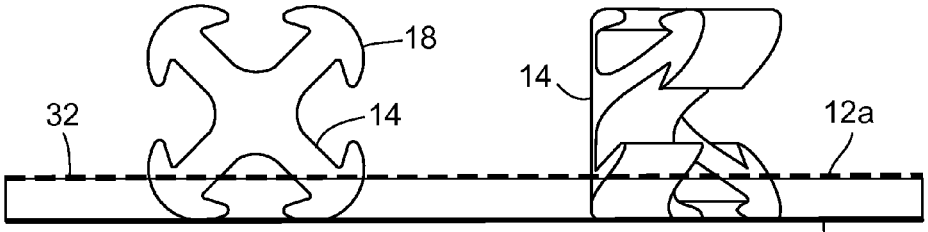
Figure 14D:
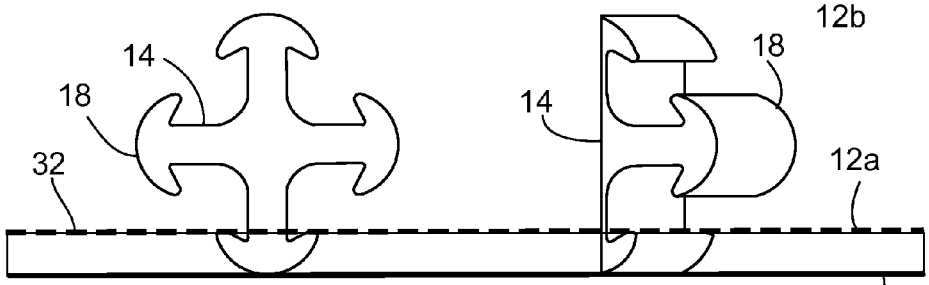
Figure 14E:
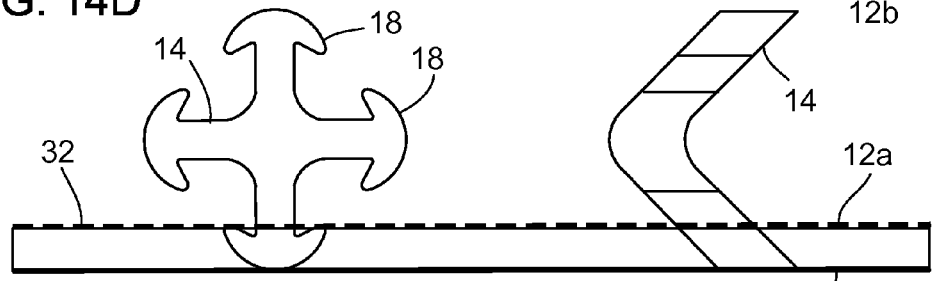

FIGS. 14C-E illustrate three other potential orientations that may be assumed by a bit 14 at rest on a horizontal surface 12. The incidence of the orientation shown in FIG. 14C, in which two heads 18 are raised at the distal ends of two projections extending at acute angles relative to surface 12, is a function of the thickness of the bit, relative to other geometric properties and linear dimensions, with a thicker bit (e.g., one resulting from a higher rail advance rate between successive cuts) more frequently assuming this orientation than a thinner bit cut from the same rail. The orientations of FIGS. 14D and 14E may be considered stable orientations only in the presence of an adhesive mechanism. In these two orientations, three engageable heads 18 are raised, one on a vertically-extending projection and two on horizontally-extending projections. Even in these three orientations, at least one projection head 18 is raised from surface 12 for loop fiber engagement.

Figure 15:
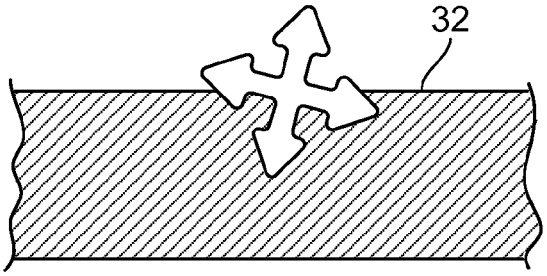
FIG. 15 shows a bit partially submerged in an adhesive coating.
Figure 16:
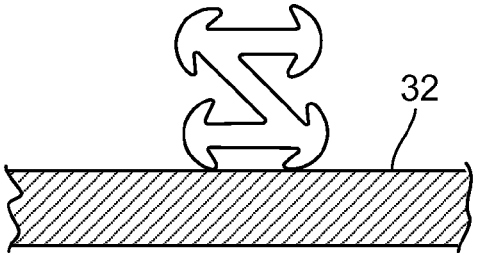
FIG. 16 shows a bit floating on an adhesive coating.

The dashed lines shown in FIGS. 14A-E represent an upper surface of an adhesive 32 fixing the bits 14 in these orientations. The dashed lines are also labeled as 12*a* to illustrate that "surface" over which the bits 14 are distributed or to which they are fixed may be a surface 12*a* of a layer of adhesive disposed on a substrate 12. The bits 14 may be partially embedded in adhesive 32 as shown in these illustrations and in FIG. 15, or float on the adhesive surface as in FIG. 16. The adhesive 32 may be in place as the bits are distributed, or may be applied afterward.

Figure 17A:
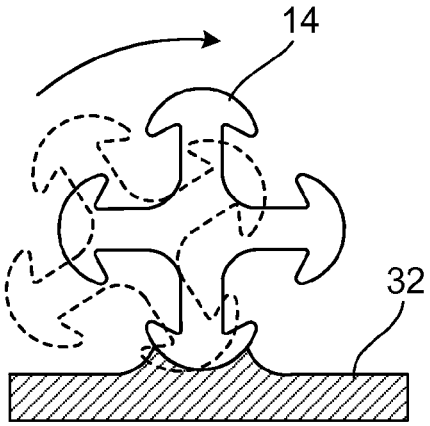
FIG. 17A illustrates a bit being righted by adhesive surface tension forces.

Even with relatively thin bits 14, the orientations shown in FIGS. 14D and 14E have been observed occurring as a result of surface tension or capillary forces at the surface of a liquid adhesive. This phenomenon is illustrated in FIG. 17A, which shows bit 14, which initially is oriented as shown by dashed outline, righting itself due to forces at the interface between the adhesive 32 and the projection head 18 in contact with the adhesive. This phenomenon appears more frequently with very light/small bits 14 and high wetting properties between the adhesive and bit materials.

Figure 17B:
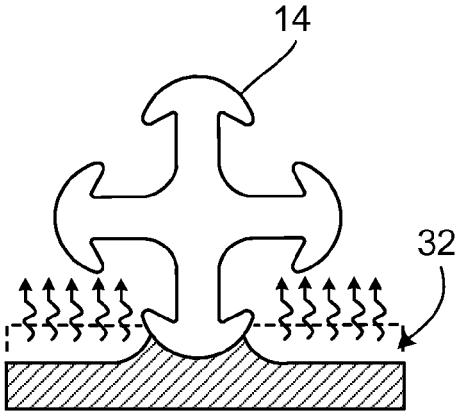
FIG. 17B shows an adhesive coating being thinned through evaporation.

Once the bits are in contact with the adhesive layer, as shown in FIG. 17B, the thickness of the adhesive 32 may be reduced by drying. In this manner, low solids water-based adhesives may be applied as coatings thicker than would otherwise be tolerable in the finished product. This figure illustrates water or solvent evaporating from the adhesive, leaving an adhesive with a higher proportion of solids fixing the bit to the surface.

Figure 18:
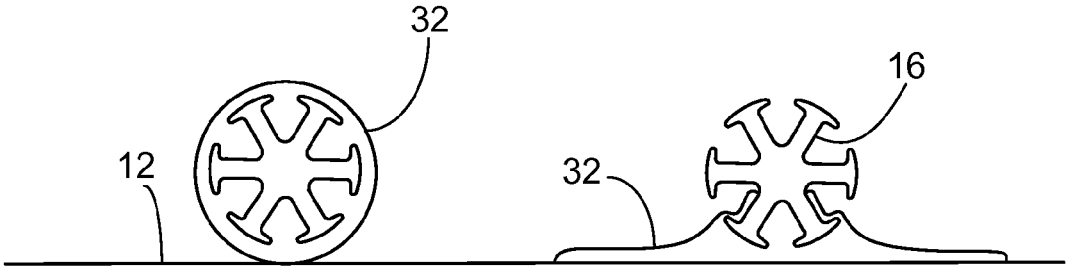
FIG. 18 illustrates fixing a bit by an adhesive bit coating.

The adhesive may also be part of the bits themselves as they are distributed onto the surface. Referring to FIG. 18, the bit on the left side of the figure is shown encased in an adhesive 32 that may also serve as a projection stabilization material during cutting (as discussed above with respect to FIG. 7D). After the encased bits are distributed onto surface 12, adhesive 32 is made to flow from the bit onto the surface, as shown in the right side of the figure, to expose at least some of the projections 16 for engagement and to fix the bit to surface 12.

Similarly, bits may be fixed to a surface, such as to a film or other solidified resin layer, by at least partially melting the surface after the bits are distributed to rest on the surface. For example, bits may at first rest on the surface of a solidified adhesive 32 (or film surface) as in FIG. 16, and then become partially embedded in the adhesive 32 as the adhesive is melted, such as to either be suspended within the adhesive (as in FIG. 15, for example), or to come to rest on an underlying substrate (as, for example, in FIG. 14A). In such cases it will generally be the case that the resin from which the bits are formed is chosen to not melt under the conditions required to melt the surface on which the bits are distributed. Such conditions could be elevated temperature, or energy supplied by radiation or other means, such as sonic vibration.

Figure 19A:
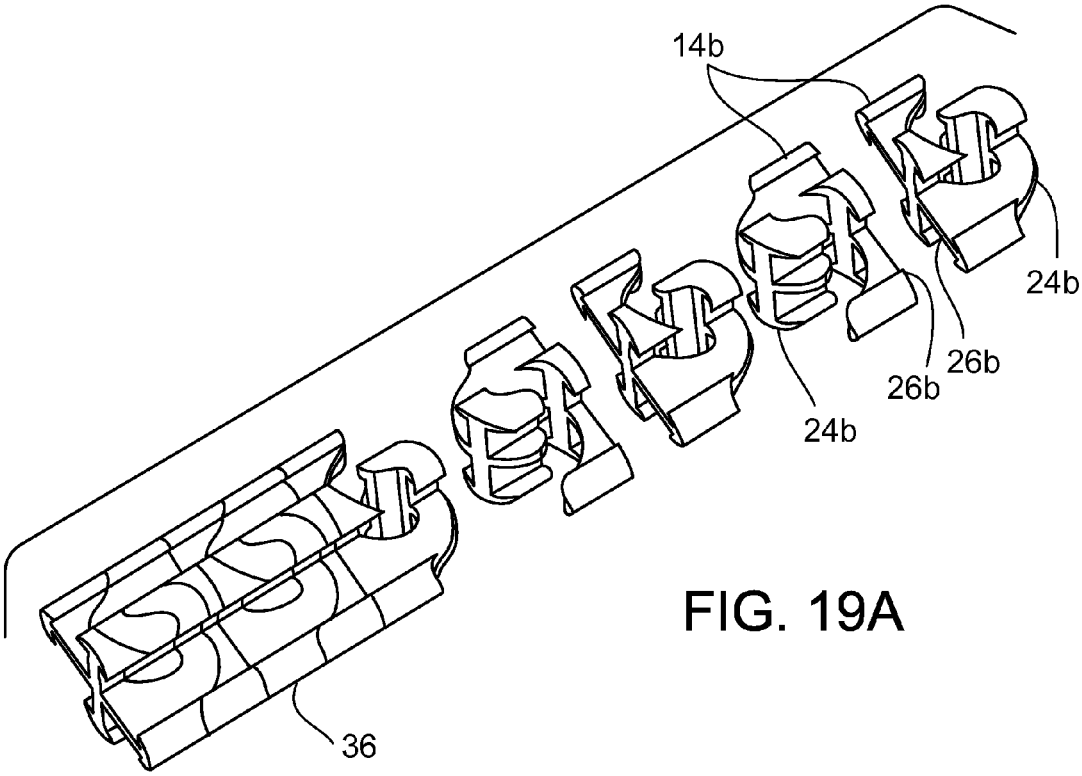
FIG. 19A is an exploded view, illustrating severing of bits with a flat side and a profiled side, from a single rail.

The bits shown in the above figures each have two non-planar severed surfaces. FIG. 19A shows how fastening bits 14*b* can be severed from a simple cross-shaped rail 36, but such that each bit 14*b* has a non-planar severed side surface 24*b* and a planar severed side surface 26*b*. The pattern of cuts for making this series of bit shapes is shown on the unsevered portion of rail 36, and the non-planar severed surfaces 24*b* of adjacent severed bits, which overlap themselves along the longitudinal axis of the rail, are shown spaced apart for illustration purposes. This cut pattern can be made, for example, with a cutting wheel having alternating non-planar and planar cutter profiles, and results in no inter-bit scrap segments to be removed from the severed bits.

Figure 19B:
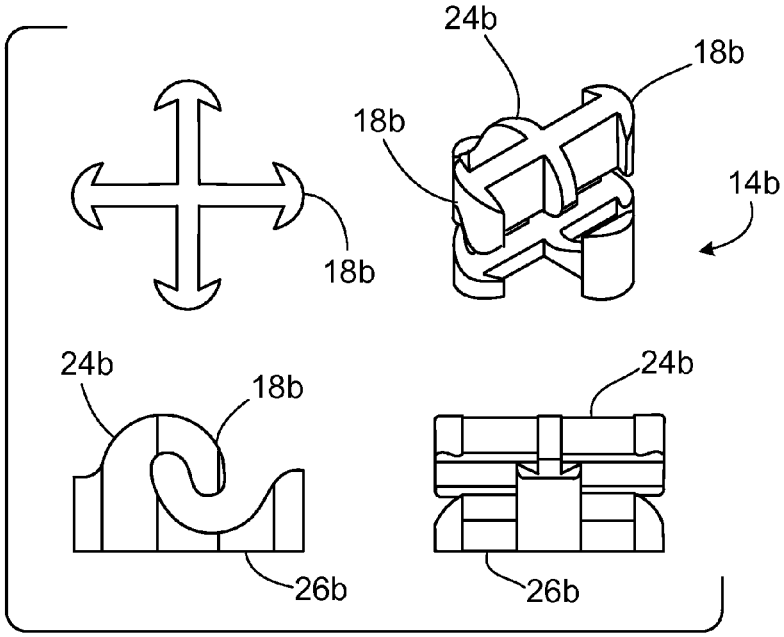
FIG. 19B shows one of the bits produced as in FIG. 19A, illustrated in one perspective and three orthogonal views.

As shown in FIG. 19B, even if bit 14*b* lands on its planar severed side 26*b* (i.e., in the orientation illustrated in the lower left quadrant of the figure), the non-planar severed side 24*b* will produced by this cutting pattern will provide at least one head 18*b* elevated for releasable engagement of fibers. As shown in the perspective view in the upper right quadrant of the figure, the intersection of the non-planar cutting pattern with the cross-shaped rail cross-section produces a number of possible fiber engagement points. Should the bit 14*b* be fixed in any of its other stable orientations, at least one engageable head is elevated.

Figure 20:
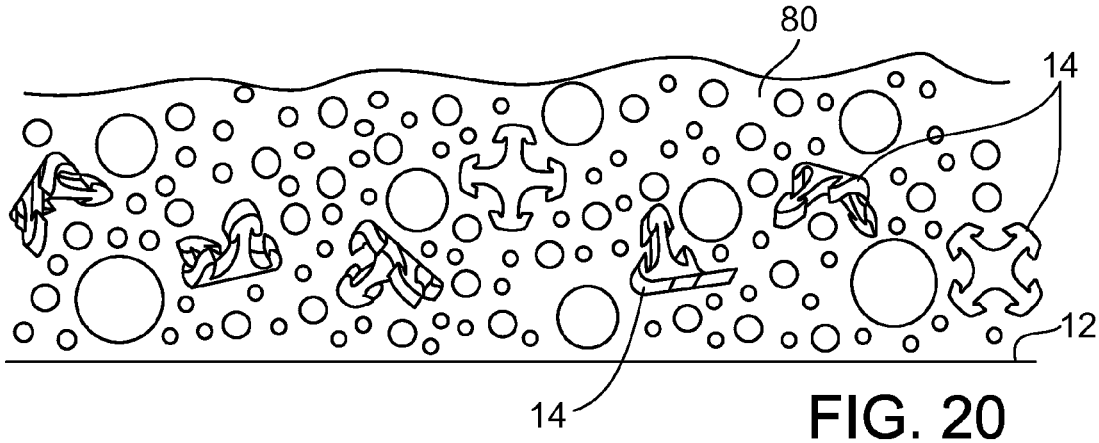
FIG. 20 is a cross-sectional view showing bits suspended in a liquid or foam carrier on a surface.

Whatever their shape, the bits may be distributed by suspending them in a carrier that is placed on the surface. For example, FIG. 20 shows a carrier 80 in which bits 14 are suspended. Carrier 80 is illustrated as an unstable foam, such as of a water based acrylic, the circles representing voids in a liquid matrix. Carrier may alternatively be a liquid without voids. Orientation and distribution of the bits within the carrier is generally random, although the bits may be charged so as to avoid bit clumping.

Figure 20A:
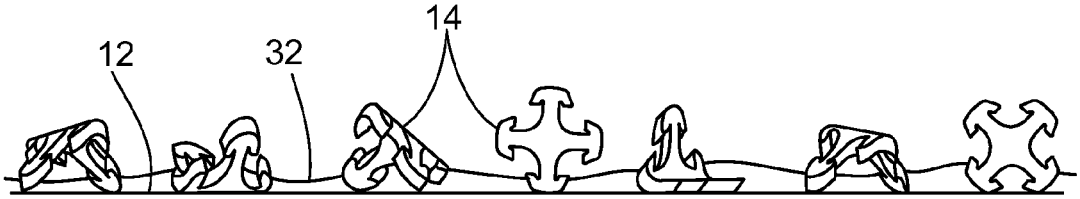
FIG. 20A shows the components of FIG. 20 after the foam has collapsed or the liquid evaporated, with the bits fixed to the surface.

After the carrier 80 containing bits 14 has been spread onto surface 12, the foam is allowed to collapse (or in the case of a pure liquid carrier, liquid from the carrier allowed to evaporate) to expose projections of the bits as shown in FIG. 20A, the remaining carrier material forming the adhesive 32 fixing the bits 14 to surface 12.

Figure 21:
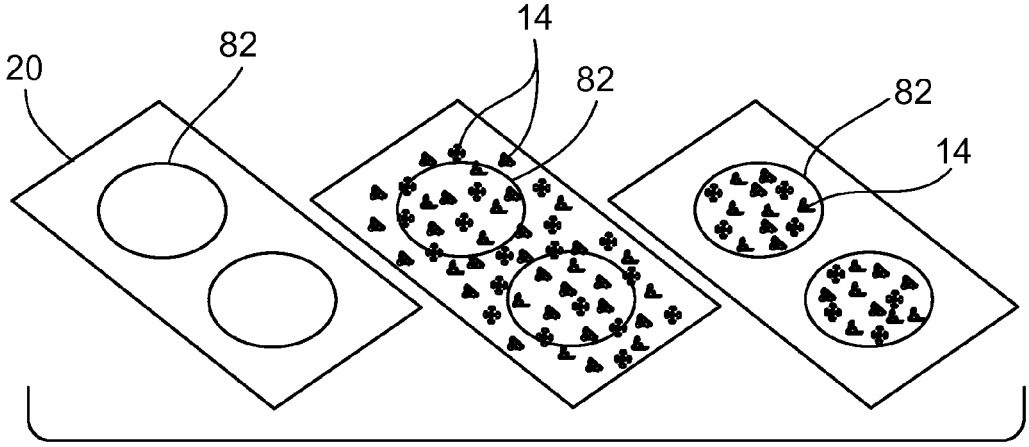
FIG. 21 illustrates fixing bits to a surface only in bounded areas.

FIG. 21 illustrates a process for fixing bits 14 onto a surface 12 in only limited areas. In this sequence, surface 12 is first provided with two bounded adhesive areas 82 (shown circular for illustration only), as illustrated on the left side of the figure. The area surrounding areas 82 is not tacky. Next, the bits 14 are distributed across the entire surface 20, including adhesive areas 82, as shown in the middle of the figure. Those bits 14 that land within an adhesive area 82 become fixed to surface 20, while bits lying outside of the adhesive areas remain unattached to the surface. Afterward, the loose bits are removed, such as by a flow of air, inverting and shaking the surface, etc., to leave only those bits fixed to the surface in the adhesive regions, as shown on the right side of the figure. This results in a product having fastening bits only in pre-defined, bounded regions, with other area of the product surface remaining relatively bit-free.

Figure 22:
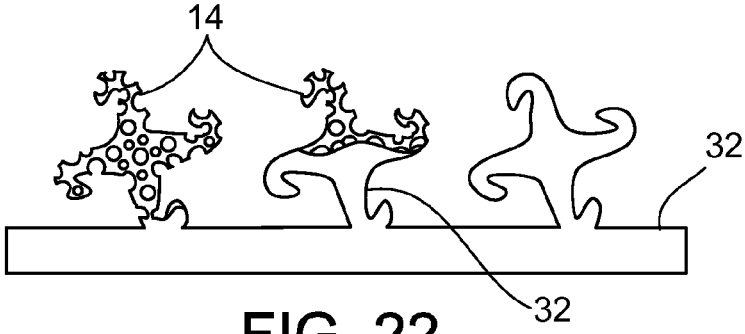
FIG. 22 shows a porous bit being fixed by adhesive wicking up the bit from the surface.

While in many cases fixing of the bits is accomplished by adhesion at an outer surface of the bit, other approaches to fixing the bits are also envisioned. For example, FIG. 22 illustrates the fixing of a bit 14 by capillary forces drawing a liquid adhesive 32 into pores of the bit, in a sequence progressing from left to right in the figure. Although for purposes of illustration the adhesive is shown wicking up the entire bit, it will be understood that in some cases the adhesive only wicks partially up the sides of the bit, or into some of the pores. Bit porosity may be provided by foaming agents supplied to the resin to be extruded into a rail from which the bits are cut after the porosity of the material is stabilized as the extruded resin is cooled.

One example of a suitable liquid adhesive 32 is V-Block™ Primer/Sealer, available from APAC in Dalton, Ga. (www.apacadhesives.com), a solvent-free, polymer based adhesive that may be applied to a surface prior to bit distribution, using a napped paint roller, a brush or even by spray coating. Such an adhesive may also provide moisture barrier properties in the final product, if applied as a solid coating. Other adhesives include KOESTER VAP 1® pH Waterproofing System, an epoxy-based waterproofing sealer available from Koester American Corporation of Virginia Beach, Va. (www.koesterusa.com), as well as acrylic laminating adhesives, and Wet-Look Sealer No. 985, an acrylic-based masonry sealer available from Behr Process Corporation. Even white school glue, such as that sold by Elmer's Products Inc. of Columbus, Ohio (www.elmers.com), has been successfully employed to fix bits to surfaces, such as by first diluting the glue with water and then allowing for evaporation after bit distribution. Other useful adhesives include paint and epoxy coatings, for example.

FIGS. 23-25 illustrate another bit-cutting process and an example of a bit structure that can result from such a process. In the process shown in FIG. 23, cutter 38 slices through a rail 36 as in the processes described above, but in this case the severed portion of rail curls as it is cut, in part due to the shape of the cutter, which defines a pocket 84 that receives and redirects the severed bit to curve away from the rail during cutting. The cutter pocket surface 84 is also canted with respect to the cutting direction, such that the severed bit material is also directed to spiral in one lateral direction. The result is a curled bit 14 as shown in FIG. 25, having two non-planar opposite side surfaces that are both generally curved with the same overall curvature, one convex and the other concave in profile. FIG. 24 shows two of the stable orientations of such a curled bit 14 as distributed over surface 12 and partially embedded in adhesive 32 to fix the bits 14 in place.

Figure 26:
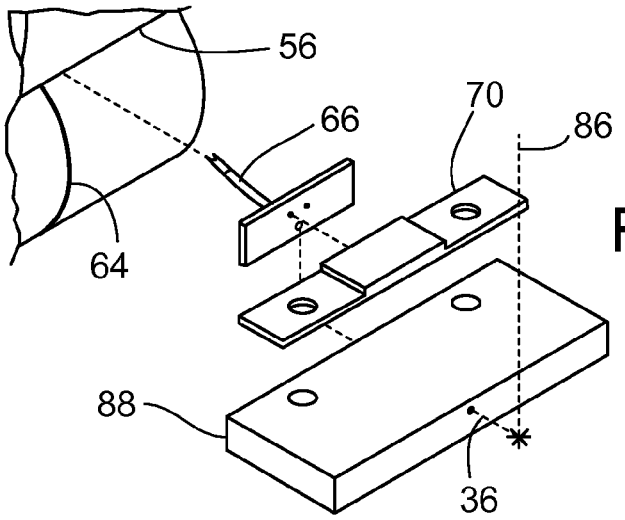
FIG. 26 shows a machine and process for laser-cutting a rail.
Figure 27:
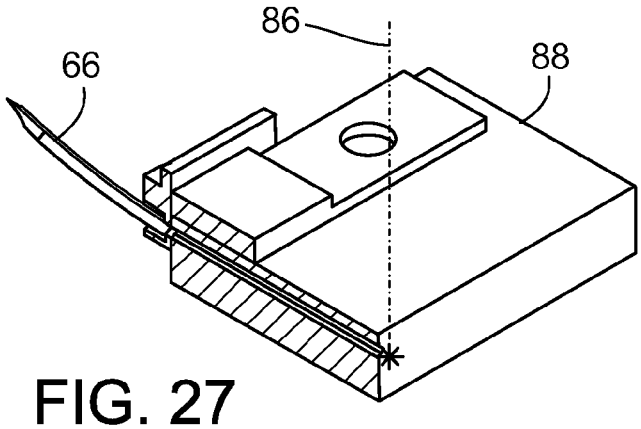
FIG. 27 is a sectioned view, showing the rail path through the rail support structure of the machine of FIG. 26.

Referring next to FIG. 26, another machine and process for cutting bits from an extruded rail features a laser beam 86 that intercepts the rail 36 as it leaves a channel in block 88 corresponding to the bed knife in the machine described above. Because no cutter forces are applied to the rail in this process, there is significantly less elastic deformation of the rail profile during cutting. The rail support and positioning system can be somewhat simplified, as no accommodation need be made for the path of the cutter. Referring also to FIG. 27, the rail support channel may be completely defined within block 88 Otherwise, the rail feeding apparatus is essentially the same as that discussed above with respect to FIGS. 8-11.

Figure 28:
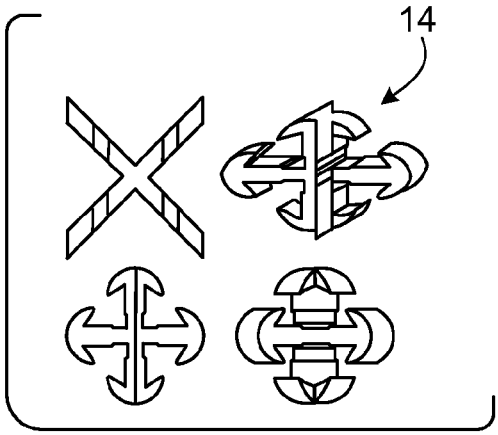
FIG. 28 shows a laser-cut fastening bit formed as in FIG. 23, in one perspective and three orthogonal views.
Figure 29:
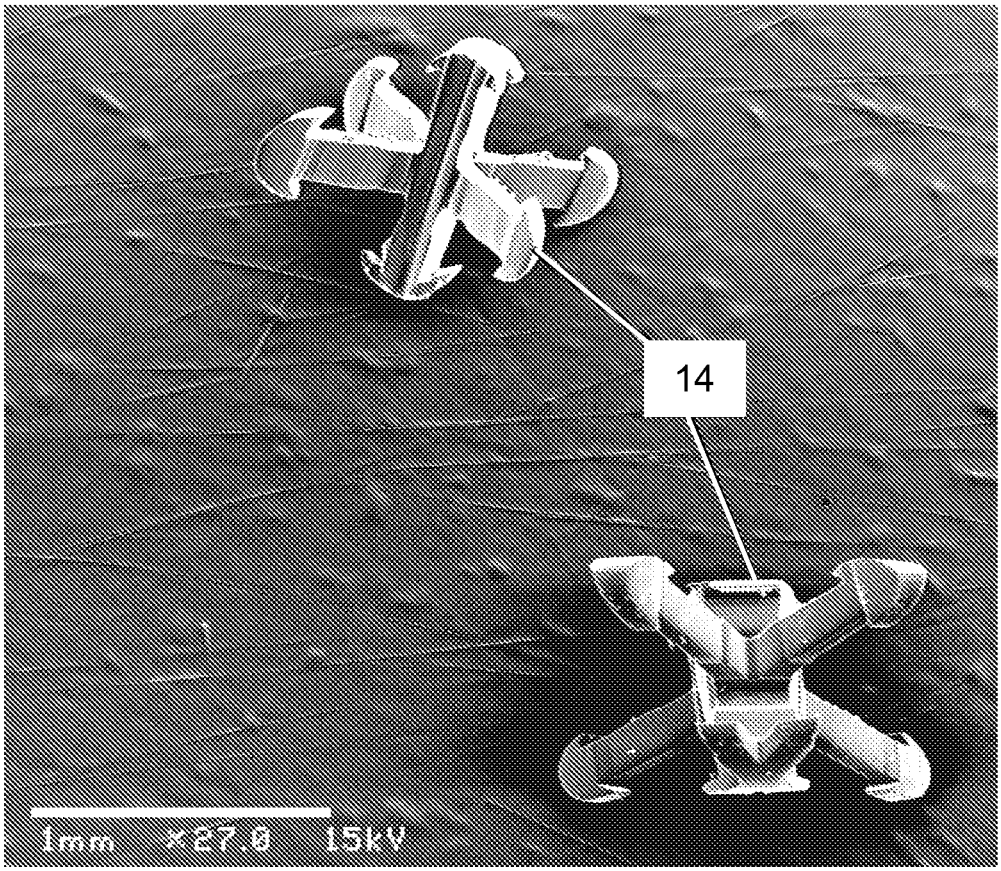
FIG. 29 is an enlarged photograph of two laser-cut fastening bits.

Cutting with a beam, such as a laser beam, enables the formation of even more complex bit shapes, such as the one shown in FIGS. 28 and 29. The cuts are made by traversing the beam along a path corresponding to the perimeter of the bit in top view (the upper left quadrant of FIG. 28). Cutting this shape requires cutting out all four V-shaped notches out of the rail segment to leave the bit as shown. A next bit of this shape will require an equal number of surfaces to be cut, with a diamond-shaped rail segment formed between the successive bits. Such a diamond-shaped segment may itself be of useful form for engaging fibers or other purposes, and may be separated from the X-shaped bits after formation.

The bits described above may be cut from rails formed of extruded polymeric resin containing a thermoplastic, such as polyurethane. An example of a useful thermoplastic polyurethane (TPU) from which the bits may be fashioned is Carbothane® 3555D B-20, an aliphatic polycarbonate-based urethane with a 20% barium sulfate loading, manufactured by Lubrizol Advanced Materials, Inc. of Wickliffe, Ohio (www.lubrizol.com). This particular material is considered a "dead" urethane, meaning it has a high degree of energy absorption and a large tan(delta), which may help contribute to clean cuts through the rails at high speeds. The barium sulfate filler is also believed to increase the deadness of the material and reduce smearing during cutting. TPU's of even higher flex modulus may be of some value as rail materials. Polyester and co-polyester exhibit the potential to cut cleanly at high cutting speeds, although perhaps by a different cleavage mechanism than TPU. Film-grade co-polyesters are also of some interest, particularly for cutting at elevated resin temperatures, such as at around 95 degrees Celsius.

Figure 30:
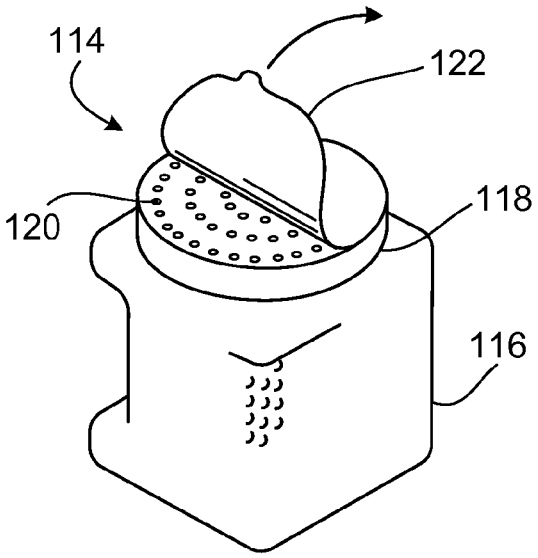
FIG. 30 is a perspective view of a container of fastening bits.
Figure 31:
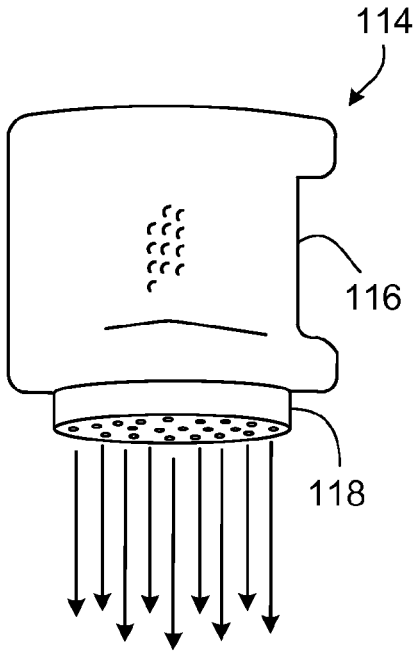
FIG. 31 shows bits being shaken from the container of FIG. 30.

As discussed above, the severed bits are dimensionally stable and can be stored and transported as a bulk material. FIG. 30 shows a container 114 in which thousands of bits are stored, loosely held in contact with each other. The container has a housing 116 defining an interior volume, and a bulk quantity of discrete bits of the sort described above contained within the volume. Housing 116 has a wide opening covered by a lid 118 defining several apertures 120 each large enough for individual bits to be shaken from the container when inverted, as shown in FIG. 31. For transportation prior to use, lid 118 is sealed with a removable cover 122. Such a container is useful, for example, as a form for retail sale of large quantities of bits, and also serves as a bit shaker.

The rest of the interior volume of the container 114 of FIGS. 30 and 31 is filled simply with air. The bits may also be packaged in a container in which they are suspended in a different flowable carrier, such as one in liquid form. Such a carrier may be a material that, when cured, serves as the adhesive for fixing the bits to a surface.

Figure 32A:
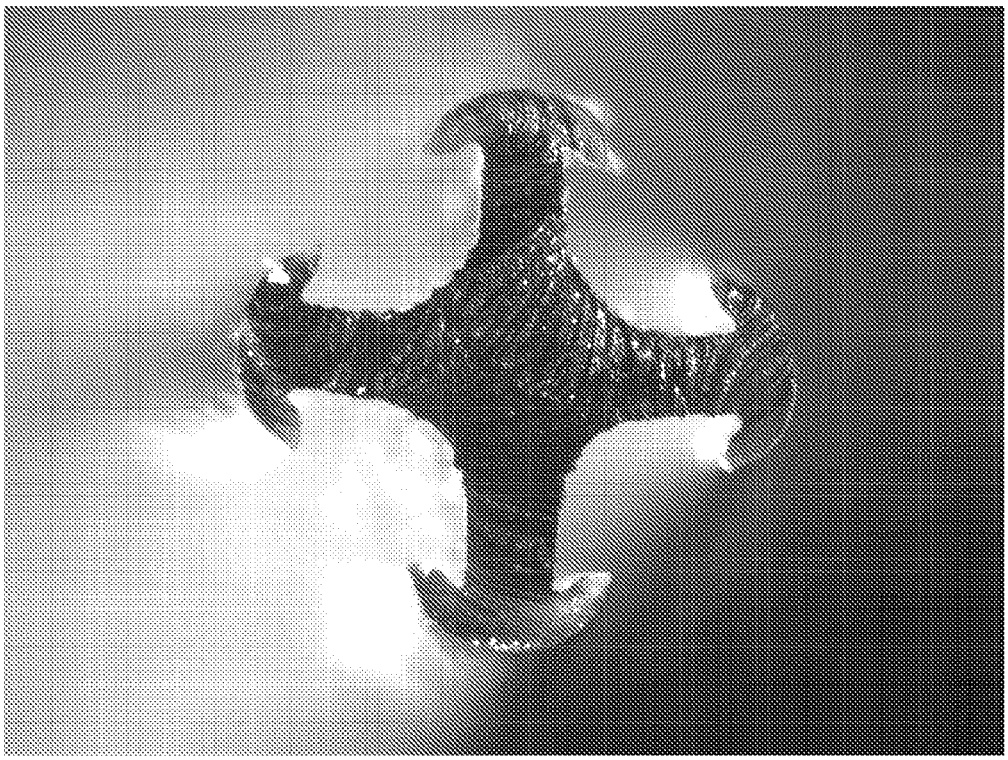
FIGS. 32A and 32B are enlarged photographs of severed surfaces.
Figure 32B:
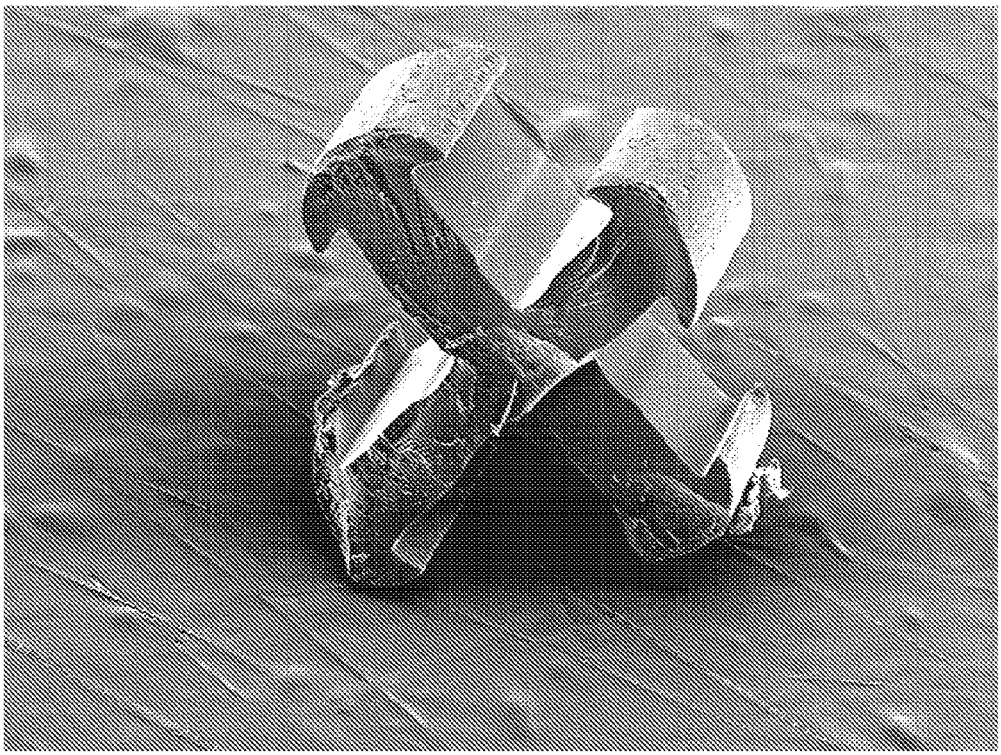

Referring next to FIGS. 32A and 32B, the temperature of the rail material during cutting, and the speed of the cutting, can impact the cut 'quality' or the characteristics of the severed surfaces of the bits. For example, it has been found that when cutting thermoplastic urethane resins, a more preferred cut quality is obtained by cutting at a temperature well above the glass transition temperature of the resin. When cutting at temperatures below or closer to the resin glass transition temperature, more significant smearing of the severed surface was observed. The same phenomenon has been observed with other non-cross-linked, amorphous polymers. The photograph of FIG. 32A is of polyester rail cut at a temperature about 23 degrees C. above its glass transition temperature, appearing to show a brittle fracture propagation that did not propagate faster than the speed of the cutter (in this case, a blade of a pair of scissors). The PET bit shown in FIG. 32B was cut from a rail that had been crystallized by heat treatment, and indicates a brittle fracture after much less elastic deformation, in which the fracture line appears to have outpaced the cutter (akin to shattering). While the resulting bit shown in FIG. 32B would still have use for fastening, having apparently engageable heads still visible on its projections, it does exhibit a lower cut quality and may indicate a cutting process that is less repeatable and controllable.

On the other hand, severing resins at temperatures well below their glass transition temperatures appears to produce a ductile fracture, with significant localized and overall plastic deformation occurring before or during fracturing.

Various of the bit designs illustrated in the drawings will have different tendencies to engage other bits in a bulk volume, or clump together. Such bit clumping can also be exacerbated by static electricity formed on the bit surfaces during cutting, but such charges tend to dissipate over time. However, we have found that a number of the bit designs discussed above may be readily broadcast or distributed over a surface simply by scattering them by hand (as one would scatter grass seeds), or by use of a commercial seed broadcaster, or even a salt shaker or particle sprayer.

Figure 33:
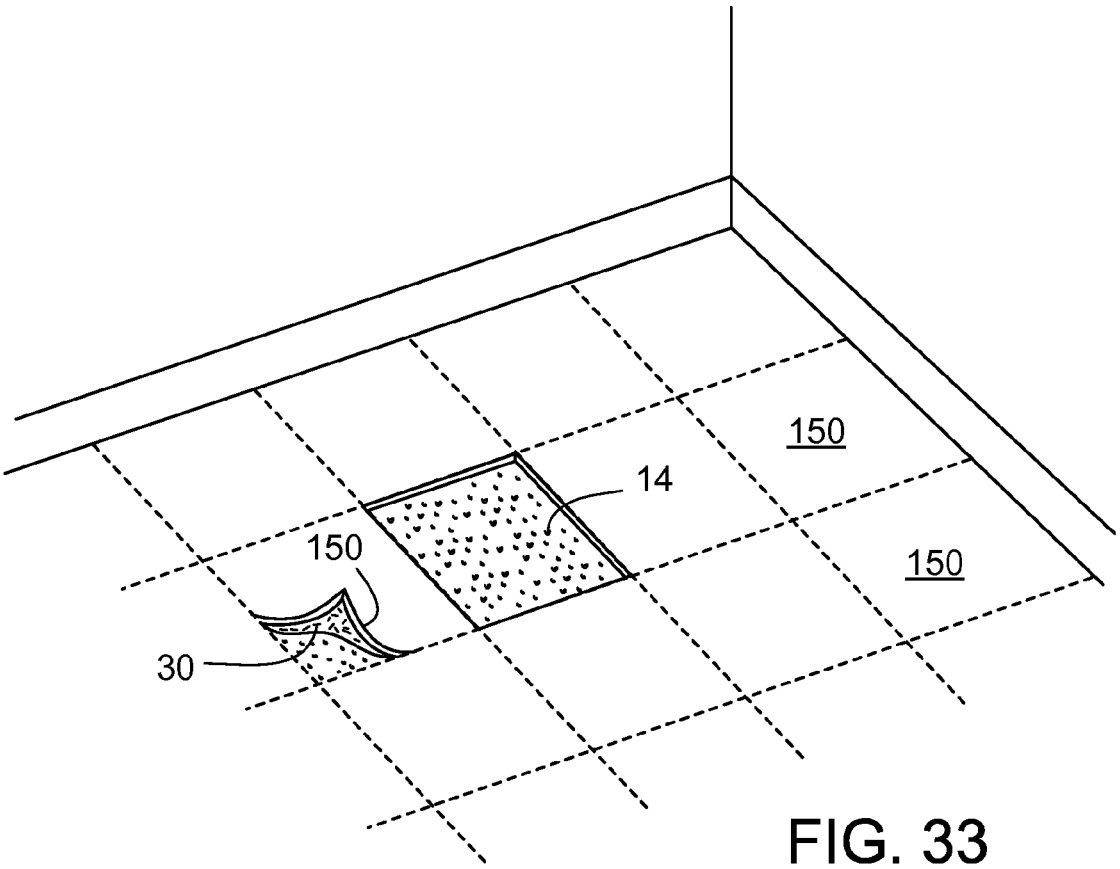
FIG. 33 shows a floor of carpet tiles secured by fastening bits.

Fastening products formed by the above methods and with fastening bits according to the above designs can be employed in a variety of ways and in a variety of industries. For example, in one application carpeting or other flooring material is releasably secured to a subfloor by first spreading an adhesive material across the subfloor, and then while the adhesive material is still tacky, distributing thousands of individual bits across the adhesive material, where they become permanently affixed. The carpeting or other flooring material can then be installed after the adhesive material is fully cured. In some cases, the adhesive material performs another function in addition to fixing the fastening bits. For example, the adhesive material may be a floor sealant that would otherwise be used to seal the floor even in the absence of this fastening concept, such that the only material added for the purposes of securing the flooring is the bits themselves. Referring to FIG. 33, the flooring can be in the form of individual carpet tiles 150 that each is held in place by the fixed fastening bits 14 engaging fibers 30 on the underside of each tile. The releasable engagement provided by the fastening bits enables worn, damaged or soiled individual tiles 150 to be removed, often without the use of any tools, and replaced with new tiles. Soiled tiles may be fully machine-washable.

Figure 34:
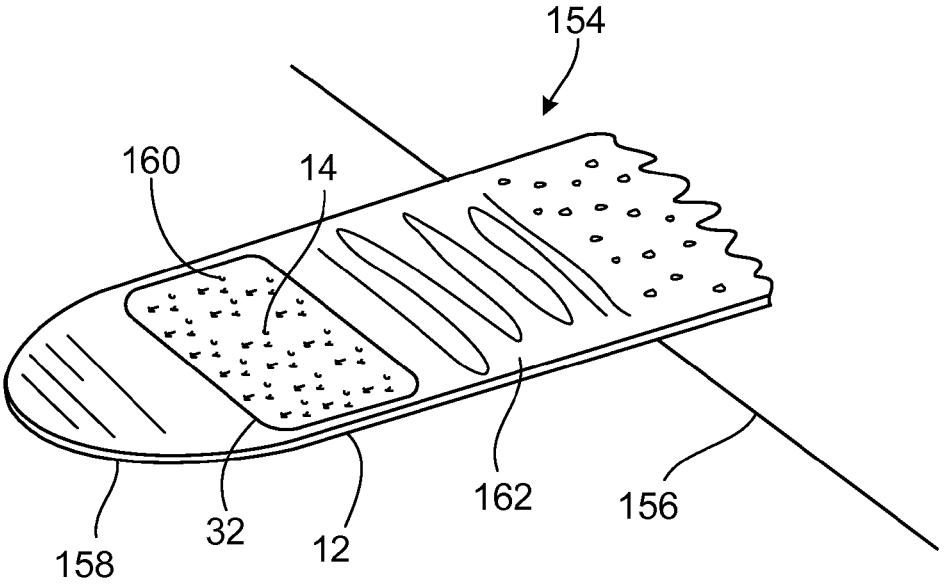
FIG. 34 is a perspective of a diaper tab with a fastening region having bits.

Referring next to FIG. 34, diaper tab 154 is permanently secured to diaper chassis 156, such as by adhesive or welds, and is in the form of an elongated, longitudinally extensible tab extending from the diaper chassis to a distal grip end 158. Between the diaper chassis and the grip end is a fastening patch 160 in which a multiplicity of fastening bits 14 (on the order of, for example, 30-50 bits) are permanently fixed in an adhesive material covering the fastening patch. The borders of the fastening patch are set back from the edges of the tab, such that the adhesive material does not contribute to any roughness at the tab edge. The region 162 of the tab between fastening patch 160 and diaper chassis 156 may be resiliently stretchable. The substrate 12 of the tab may be a non-woven material or a film, for example.

Figure 35:
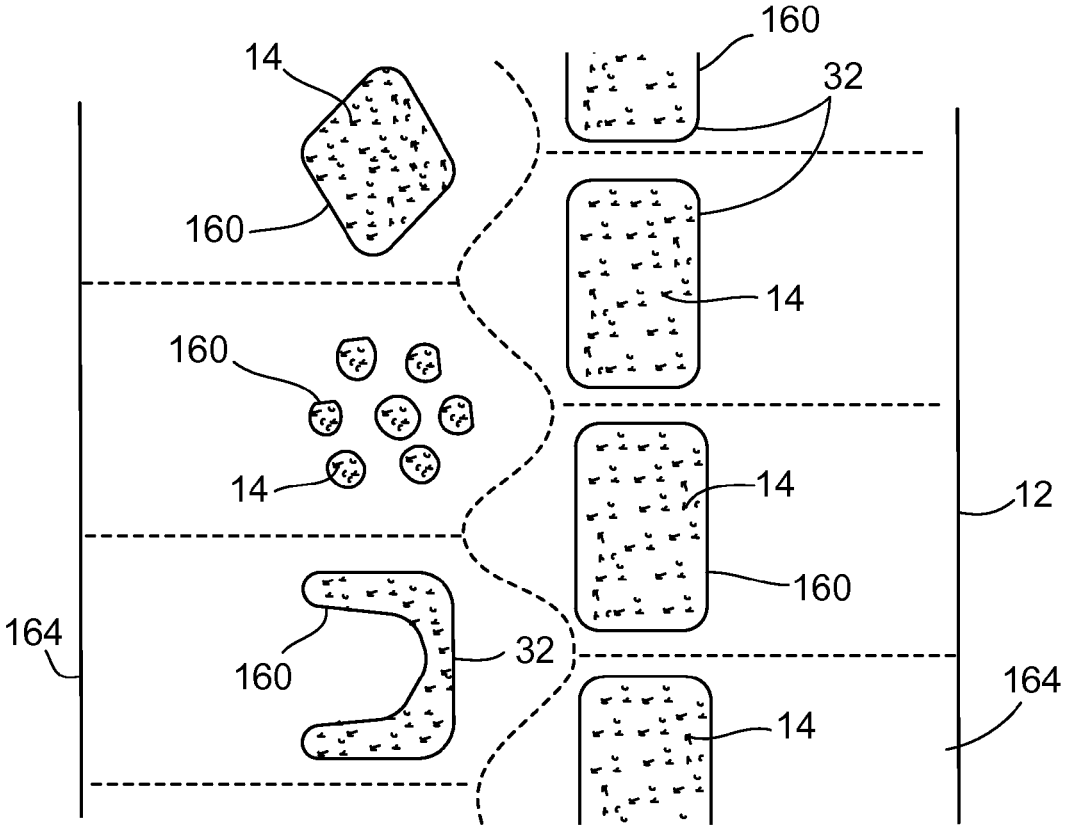
FIG. 35 shows a diaper tab cut pattern and various engagement patch configurations.

Diaper tabs can be formed in a continuous process in which adhesive and fastening bits are first applied to a substrate, which is then segmented into individual tabs. Referring to FIG. 35, longitudinally continuous substrate 12 has longitudinal edges 164 and is fed into a process, such as that of FIG. 9, in which patches of adhesive 32 are printed onto the substrate in a desired pattern, and then bits 14 are fixed in the adhesive prior to the substrate being segmented into individual diaper tabs, such as by cutting along the dashed lines shown, which may occur after the substrate is spooled and shipped to a diaper manufacturer. The arrangement of patches 160 shown in this figure is to illustrate the wide variety of patch shapes and configurations that are possible. For example, the right half of the figure shows a longitudinal series of rectangular patches sized and spaced to each be fully encompassed by a tab severed from the substrate along the dashed lines, such as the tab shown in FIG. 34. The left half of the figure shows three alternative fastening patch shapes. The upper patch is generally diamond-shaped, and provides a progressively increasing peel force when peeled from the grip tab end, until the middle, widest region of the patch is reached, after which the peel force progressively decreases. The middle tab on the left side of the figure features seven discrete adhesive patches 160, with six of the patches arranged in a circle about a center patch. Each of the patches contains a plurality of fastening bits 14. Because these relatively small patches are separated from one another by substrate free of adhesive 32, the overall flexibility of the fastener tab is relatively unaltered within its fastening region, with respect to bending in any direction. The patch shown in the lower left portion of the figure is of a shape that presents a relatively high initial peel resistance when peeled from the grip end or from either of its longitudinal sides, but the peel resistance diminishes rapidly as the peel progresses from the grip end. Many other patch configurations are possible.

Figure 36:
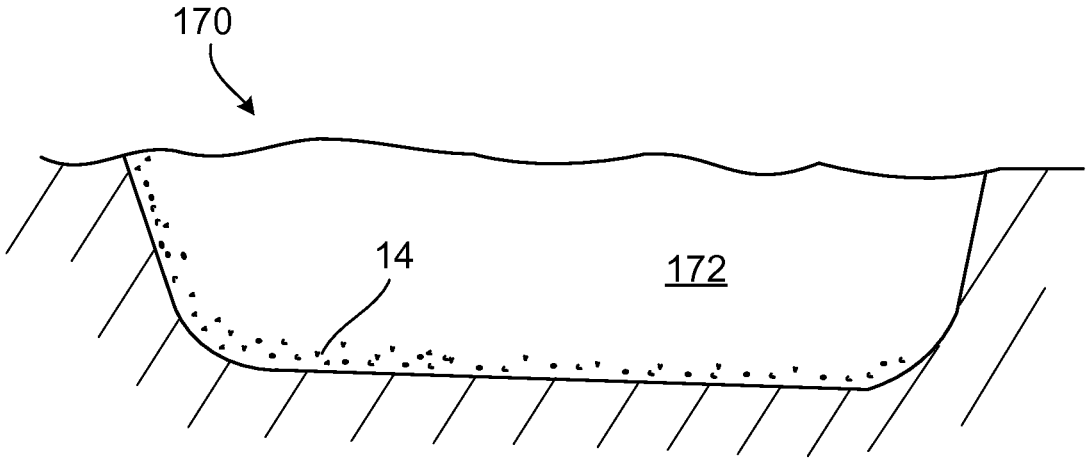
FIG. 36 is a partial cross-sectional view of a mold cavity for molding a foam article.

Bits may also be fixed to a surface by the formation of that surface. Referring next to FIG. 36, a mold 170 defines an interior cavity 172 for molding an article, such as a foam seat cushion. Prior to introducing the foaming resin into the cavity, bits 14 are distributed over the surface of the mold. The bits may simply lie against the mold surface under the force of gravity, as with the bits shown along the lower surface of the mold cavity, or they may be temporarily held in place on the surface, such as in a release agent or tacky substance applied to the mold surface that is broken down by the foaming process, either chemically or by heat given off by the curing foam. The bits may also be held against the mold surface by static electrical attraction, such as by placing a static charge on the bits, and then applying an opposite charge to the mold surface, such that the bits remain on even vertical mold surfaces until contacted by, and embedded in the surface of, the foaming resin forming the article. The bits on the left side wall of the mold cavity are illustrated as held in place by static electricity. The bits may also be formed of a resin that contains magnetically attractable particles, or be coated with a magnetically attractable substance, and then held in place by magnets or electromagnets embedded in the mold surface. Such magnets may be strategically shaped and placed to correspond with regions of the molded article intended to be fastenable, such as to a fabric seat cover.

Figure 37:
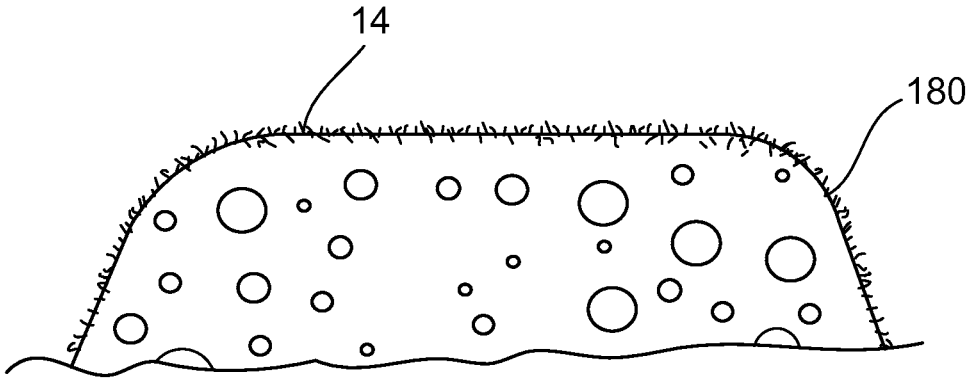
FIG. 37 is a partial cross-sectional view of an article molded in the cavity of FIG. 36.

Referring also to FIG. 37, the bits become embedded in the surface of article 180, with at least some of their projections extending for releasable engagement with fibers of an inner surface, such as a cover (not shown) stretched over the article. After the molded article is removed from its molding cavity, it is expected that some bits will be fully embedded and non-functional, other bits will not be securely attached and may be blown or brushed from the surface, and yet other bits will be functionally partially embedded in the surface. The depth of the layer of bits to be distributed onto the mold surface prior to article formation should be sufficient that not all of the bits are fully embedded, but not so deep as to provide an unacceptable surface topography. The appropriate depth will depend, for example, on bit shape and foam characteristics.

While a number of examples have been described for illustration purposes, the foregoing description is not intended to limit the scope of the invention, which is defined by the scope of the appended claims. There are and will be other examples and modifications within the scope of the following claims.

What is claimed is:

1. A method of making a touch fastener product, the method comprising distributing a multiplicity of discrete fastening bits over a support surface, each bit having opposite side surfaces forming boundaries of surfaces defining projections extending in different directions from the fastening bits, at least one of the opposite side surfaces being non-planar, and each projection having an overhanging head; and fixing the distributed bits to the support surface, at least some of the fixed bits each supported on at least two of its projection heads adhered to the support surface and spaced laterally across the support surface, and with another of its projection heads raised from the support surface to releasably engage fibers.

2. The method of claim 1, wherein distributing the bits causes them to orient with at least one projection head raised from the support surface.

3. The method of claim 1, wherein distributing the bits comprises distributing a liquid onto the support surface, the liquid containing the bits in suspension.

4. The method of claim 1, wherein distributing the bits comprises distributing the bits in a foam carrier that collapses on the support surface.

5. The method of claim 1, wherein the support surface comprises both adhesive regions and non-adhesive regions, and wherein distributing the bits comprises:

distributing the bits over both the adhesive and non-adhesive regions; and then removing distributed bits from the non-adhesive regions.

6. The method of claim 1, wherein fixing the distributed bits comprises heating the bits to cause a portion of each bit to melt and bond to the support surface.

7. The method of claim 1, wherein the bits are porous and fixing the distributed bits involves adhesive being drawn from the surface into pores of the bits.

8. The method of claim 1, wherein both of the opposite sides are non-planar.

9. A method of making a fastening bit, the method comprising cutting completely through a longitudinal rail defining a longitudinal axis and having multiple ribs defining undercuts and extending in different directions, the cutting occurring at discrete intervals along the longitudinal axis of the rail to form discrete and separate fastening bits, the cutting forming opposite side surfaces of each bit, at least one of which opposite side surfaces is non-planar, such that each bit is in the form of a solid body defined between the opposite side surfaces, each side surface bounded by a respective peripheral edge of the bit, the bit having a peripheral surface extending between the peripheral edges and defining projections extending in different directions, each projection having an overhanging head defining a crook for engaging fibers and at least one of the opposite side surfaces being non-planar; and collecting the fastening bits.

10. The method of claim 9, wherein cutting through the rail comprises moving a cutter along a substantially linear path through the rail.

11. The method of claim 9, wherein the cutter is mounted at an outer edge of a wheel and moves along a circular path that has a radius at least 40 times a distance that the cutter cuts through the rail.

12. The method of claim 9, wherein cutting through the rail causes material being severed from the rail to curl away from the cutter to form a non-planar one of the opposite side surfaces of one of the fastening bits.

13. The method of claim 9, wherein each cut through the rail forms a similar cut shape, such that both of the opposing side surfaces are non-planar and of complementary topography.

14. A fastening bit in the form of a solid body defined between two opposite side surfaces each side surface bounded by a respective peripheral edge of the bit, the bit having a peripheral surface extending between the peripheral edges and defining projections extending in different directions, each projection having an overhanging head defining a crook for engaging fibers and at least one of the opposite side surfaces being non-planar.

15. The bit of claim 14, wherein the bit has an overall thickness, measured between the side surfaces, that is less than a maximum overall linear dimension of the bit.

16. A touch fastener product comprising a support surface; and a multiplicity of the fastening bits of claim 14 dispersed across and fixed to the support surface in various orientations;

wherein each fixed bit is oriented with at least one of its projections extending away from the support surface for releasable engagement of fibers.

17. A container of bits, the container comprising:

a housing defining an interior volume; and a bulk quantity of the fastening bits of claim 14 contained within the volume.

18. The container of claim 17, wherein the bits are loosely disposed within the volume.

19. A method of installing a floor covering, the method comprising distributing a multiplicity of the fastening bits of claim 14 over a floor;

fixing the distributed bits to the floor with adhesive, with each bit oriented with at least one of its projection heads raised from the floor to releasably engage fibers; and placing a floor covering over the floor, the floor covering having exposed fibers on a surface of the floor covering facing the floor, such that the fixed bits engage and retain the exposed fibers of the floor covering to releasably secure the floor covering to the floor.

20. The method of claim 1, wherein as fixed to the support surface, each bit is oriented with at least one projection head extending away from the support surface.

21. The method of claim 8, wherein the opposite sides are of complementary topography.

22. The method of claim 10, wherein the cutter comprises a solid cutting edge that forms an acute cutting angle.

23. The hit of claim 14, wherein both of the opposite side surfaces are non-planar.

24. The bit of claim 14, wherein both of the opposite side surfaces are of complementary topography.

25. The bit of claim 14, wherein the projections extend in more than two different directions.

26. The bit of claim 14, wherein all linear dimensions of the bit are less than about 1.2 millimeters.

27. The container of claim 17, wherein the bits are suspended in a flowable carrier.

28. The container of claim 17, wherein the bits are of an average bit size of less than three millimeters across.

29. A method of making a touch fastener product, the method comprising distributing a multiplicity of discrete fastening bits over a support surface, each bit having opposite side surfaces forming boundaries of surfaces defining projections extending in different directions from the fastening bits, at least one of the opposite side surfaces being non-planar, and each projection having an overhanging head; and fixing the distributed bits to the support surface, with each bit oriented with at least one of its projection heads raised from the support surface to releasably engage fibers;

wherein distributing the bits comprises distributing a liquid onto the support surface, the liquid containing the bits in suspension.

30. A method of making a touch fastener product, the method comprising distributing a multiplicity of discrete fastening bits over a support surface, each bit having opposite side surfaces forming boundaries of surfaces defining projections extending in different directions from the fastening bits, at least one of the opposite side surfaces being non-planar, and each projection having an overhanging head; and fixing the distributed bits to the support surface, with each bit oriented with at least one of its projection heads raised from the support surface to releasably engage fibers;

wherein distributing the bits comprises distributing the bits in a foam carrier that collapses on the support surface.

31. A method of making a touch fastener product, the method comprising distributing a multiplicity of discrete fastening bits over a support surface, each bit having opposite side surfaces forming boundaries of surfaces defining projections extending in different directions from the fastening bits, at least one of the opposite side surfaces being non-planar, and each projection having an overhanging head; and fixing the distributed bits to the support surface, with each bit oriented with at least one of its projection heads raised from the support surface to releasably engage fibers;

wherein the support surface comprises both adhesive regions and non-adhesive regions, and wherein distributing the bits comprises:

distributing the bits over both the adhesive and non-adhesive regions; and then removing distributed bits from the non-adhesive regions.

32. A method of making a touch fastener product, the method comprising distributing a multiplicity of discrete fastening bits over a support surface, each bit having opposite side surfaces forming boundaries of surfaces defining projections extending in different directions from the fastening bits, at least one of the opposite side surfaces being non-planar, and each projection having an overhanging head; and fixing the distributed bits to the support surface, with each bit oriented with at least one of its projection heads raised from the support surface to releasably engage fibers;

wherein the bits are porous and fixing the distributed bits involves adhesive being drawn from the surface into pores of the bits.

* * * * *